US005369422A

United States Patent [19]

Yoshida et al.

[11] Patent Number: 5,369,422

[45] Date of Patent: Nov. 29, 1994

[54] THERMAL TRANSFER RECORDING METHOD IN WHICH AN INK SHEET IS MOVED AT A SELECTED SPEED AND APPARATUS FOR PERFORMING THE SAME

[75] Inventors: Takehiro Yoshida, Tokyo; Hisao Terajima, Yokohama; Satoshi Wada, Kawasaki; Takeshi Ono, Yokohama; Makoto Kobayashi, Tama; Minoru Yokoyama, Yokohama; Takashi Awai, Yokohama; Akihiro Tomoda, Yokohama; Yasushi Ishida, Tokyo, all of Japan

[73] Assignee: Canon Kabushiki Kaisha, Tokyo, Japan

[21] Appl. No.: 154,716

[22] Filed: Nov. 19, 1993

Related U.S. Application Data

[63] Continuation of Ser. No. 764,128, Sep. 24, 1991, abandoned, which is a continuation of Ser. No. 409,949, Sep. 20, 1989, abandoned.

[30] Foreign Application Priority Data

| | | | |
|---|---|---|---|
| Sep. 22, 1988 | [JP] | Japan | 63-236367 |
| Sep. 22, 1988 | [JP] | Japan | 63-236369 |
| Oct. 4, 1988 | [JP] | Japan | 63-248982 |
| Oct. 28, 1988 | [JP] | Japan | 63-270880 |

[51] Int. Cl.[5] ..... B41J 2/325; B41J 17/06

[52] U.S. Cl. ..... 346/76 PH; 400/232

[58] Field of Search ..... 346/76 PH; 400/223, 400/224, 224.1, 224.2, 225, 227, 232, 235, 235.1, 236, 236.1, 236.2

[56] References Cited

U.S. PATENT DOCUMENTS

| | | | |
|---|---|---|---|
| 4,209,708 | 6/1980 | Galimberti | 250/548 |
| 4,447,832 | 5/1984 | Kurata et al. | 346/76 PH |
| 4,531,135 | 7/1985 | Toshima | 346/76 PH |
| 4,561,789 | 12/1985 | Saito | 346/76 PH |
| 4,577,199 | 3/1986 | Saiki et al. | 346/76 PH |
| 4,605,938 | 8/1986 | Matsuno et al. | 346/76 PH |
| 4,703,346 | 10/1987 | Bierhoff | 358/75 |
| 4,724,447 | 2/1988 | Oda | 346/76 PH |

FOREIGN PATENT DOCUMENTS

| | | | |
|---|---|---|---|
| 2388745 | 11/1978 | Japan . | |
| 58-201686 | 11/1983 | Japan . | |
| 0012087 | 3/1985 | Japan | 400/232 |
| 60-83864 | 5/1985 | Japan . | |
| 60-236779 | 11/1985 | Japan . | |
| 0135773 | 6/1986 | Japan . | |
| 0050182 | 3/1987 | Japan | 400/232 |
| 2161756 | 1/1986 | United Kingdom | 400/232 |

OTHER PUBLICATIONS

Sweet et al., "Reduced Consumption of Ribbon On An Impact Printer", IBM Bulletin, vol. 23, No. 8, Jan. 1981, p. 3506.

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A thermal transfer recording apparatus for transferring an ink of an ink sheet to a recording medium to record an image on the recording medium includes a conveying unit for conveying the ink sheet, a determining unit for determining a relative speed of the ink sheet with respect to the recording medium in correspondence with image information, and a control unit for controlling the conveying unit on the basis of the relative speed determined by the determining unit. A thermal transfer recording method is also disclosed.

23 Claims, 19 Drawing Sheets

THERMAL TRANSFER RECORDING METHOD IN WHICH AN INK SHEET IS MOVED AT A SELECTED SPEED AND APPARATUS FOR PERFORMING THE SAME

This application is a continuation of application Ser. No. 07/764,128 filed Sep. 24, 1991, abandoned, which is a continuation of Ser. No. 07/409,949 filed Sep. 20, 1989, abandoned.

BACKGROUND OF THE INVENTION

1. Field of the Invention

The present invention relates to a thermal transfer recording method and a recording apparatus using the same wherein an ink is transferred from an ink sheet to a recording medium to record an image on the recording medium.

Such thermal transfer recording apparatuses may include, e.g., a facsimile apparatus, an electronic typewriter, a copying machine, and a printer.

2. Description of the Related Art

In general, conventional thermal transfer printers use ink sheets made by applying thermally meltable (or thermally sublimable) inks to base films. Such ink sheet are selectively heated by a thermal head in correspondence with image signals, and the melted or sublimed ink is transferred to the recording sheet, thereby performing image recording. In general, the ink is perfectly and completely transferred in each image recording cycle (e.g., a so-called one-time sheet). Upon completion of one-character or one-line recording, an ink sheet is conveyed by an amount corresponding to a recording length, and a nonused portion of the ink sheet must be located to the next recording position. For this reason, an amount of ink sheet used is increased to result in an increase in running cost of a thermal transfer printer as compared with a conventional thermal printer for recording on a heat-sensitive paper.

In order to solve the above problem, thermal transfer printers as disclosed in U.S. Pat. No. 4,456,392, Japanese Patent Laid-Open No. 58-201686, and Japanese Patent Publication No. 62-58917 are proposed to differentiate a recording paper conveying speed from an ink sheet conveying speed. As described in these prior arts, an ink sheet capable of performing image recording a plurality of times (n times) is known as a so-called multi-print sheet. When this ink sheet is used and recording of a length L is repeated, the conveying length of the ink sheet conveyed upon each image recording cycle or during image recording can be smaller than the length L (i.e., L/n: n>1). Therefore, utilization efficiency of the ink sheet can be increased by n times, and a decrease in running cost of the thermal transfer printer can be expected. This recording scheme is called a multi-print scheme.

In this multi-print scheme, a conveying speed $V_P$ of the recording paper is given by the following equation:

$$V_p = n \cdot V_I (n > 1)$$

where $V_I$ is the conveying speed of the ink sheet. The value n is closely associated with image recording quality and may often be changed due to a recording speed. A change in value n is required to prevent formation of wrinkles of an ink sheet as in a case wherein equi-speed recording in a copy mode and intermittent recording in the image reception/recording mode are performed in a facsimile apparatus.

In addition, according to the multi-print scheme as described in the above references, the distance of conveyance of the ink sheet with respect to the recording paper is kept unchanged because the number of multi-prints is always fixed. For example, if an ink sheet whose number of multi-print cycles is five is used, a recording density is low if the number of multi-print cycles exceeds 5. Otherwise, the ink sheet is wasted. It is expected that the number of multi-print cycles of a future ink sheet is increased along with technological developments. Strong demand has arisen for developing a thermal transfer printer in which the number of multi-print cycles corresponds to the ink sheet.

There is also a user's need for saving the ink sheet when the recording density of an image can be relatively low. However, no conventional thermal transfer printer can satisfy this need.

Furthermore, in a conventional thermal transfer printer, a ratio of the feed amount of the ink sheet to the feed amount of the recording paper is kept at a given value. For this reason, when a multi-print sheet is used in a recording unit of, e.g., a facsimile apparatus, and the ink sheet almost runs out in the receiving mode, in the worst case, the last page cannot be printed to the end and facsimile reception is disabled. When the ink sheet runs out during reception, a transmission error occurs on the transmitting side. The transmitting side must resend the page subjected to an error, and the receiving side must change the ink sheet.

In the conventional multi-print scheme using the above conventional ink sheet, as described in the above references, the distance of conveyance of the ink sheet with respect to the recording paper is kept unchanged. This indicates that the multi-print count is kept unchanged. For example, if an ink sheet whose number of multi-print cycles is five is used, a recording density is low if the number of multi-print cycles exceeds 5. Otherwise, the ink sheet is wasted although the recording density is increased. It is expected that the number of multi-print cycles of a future ink sheet is increased along with technological developments. Strong demand has arisen for developing a facsimile apparatus using a thermal transfer printer in which the number of multi-print cycles corresponds to the ink sheet. Furthermore, in communication between facsimile apparatuses, the number of multi-print cycles of the receiving facsimile apparatus is often required to be specified by an operator at a transmitting facsimile apparatus in accordance with types of transmitting original.

SUMMARY OF THE INVENTION

It is an object of the present invention to provide a thermal transfer recording method and a recording apparatus using the same, in which image quality can be improved.

It is another object of the present invention to provide a thermal transfer recording method and a recording apparatus using the same, in which consumption of an ink sheet can be reduced.

It is still another object of the present invention to provide a thermal transfer recording method and a recording apparatus using the same, in which running cost can be reduced.

It is still another object of the present invention to provide a thermal transfer recording method and a recording apparatus using the same, in which a ratio (n)

of a conveying speed of an ink sheet to that of a recording medium can be changed.

It is still another object of the present invention to provide a thermal transfer recording method and a facsimile apparatus using the same, in which a ratio (n) of a conveying speed of an ink sheet to that of a recording medium can be controlled in correspondence with image information.

It is still another object of the present invention to provide a thermal transfer recording apparatus capable of arbitrarily setting the number of multi-print cycles and changing a conveying distance of the ink sheet with respect to the recording medium in accordance with the set number of multi-print cycles.

It is still another object of the present invention to provide a thermal transfer recording apparatus capable of setting the number of multi-print cycles in correspondence with an ink sheet.

It is still another object of the present invention to provide a thermal transfer recording apparatus capable of transferring and recording recording data having a desired length by shortening the amount of ink sheet used with respect to a recording medium having a predetermined length in correspondence with the remain of the ink sheet.

It is still another object of the present invention to provide a thermal transfer recording apparatus capable of selecting whether the conveying length of the ink sheet with respect to a recording medium having a predetermined length is changed.

It is still another object of the present invention to provide a facsimile apparatus capable of designating the number of multi-print cycles of a receiving facsimile apparatus from a transmitting facsimile apparatus, wherein the conveying distance of the ink sheet with respect to the recording medium is changed in accordance with the designated number of multi-print cycles, and multi-print image recording can be performed on the basis of the number of multi-print cycles designated by the transmitting facsimile apparatus.

DETAILED DESCRIPTION OF THE PREFERRED EMBODIMENTS

Preferred embodiments of the present invention will be described in detail with reference to the accompanying drawings.

The following embodiment exemplifies a scheme for determining a speed of an ink sheet relative to a recording medium in correspondence with characteristics of image information. A conveying means for conveying the ink sheet is controlled on the basis of the determined relative speed. In addition, a facsimile apparatus is also exemplified in which a speed of an ink sheet relative to a recording medium is determined in correspondence with image information input from transmitting/receiving means or image input means. In this facsimile apparatus, a conveying means for conveying an ink sheet is controlled on the basis of the determined relative speed.

[Description of Facsimile Apparatus (FIGS. 1 and 2)]

Figure 1:
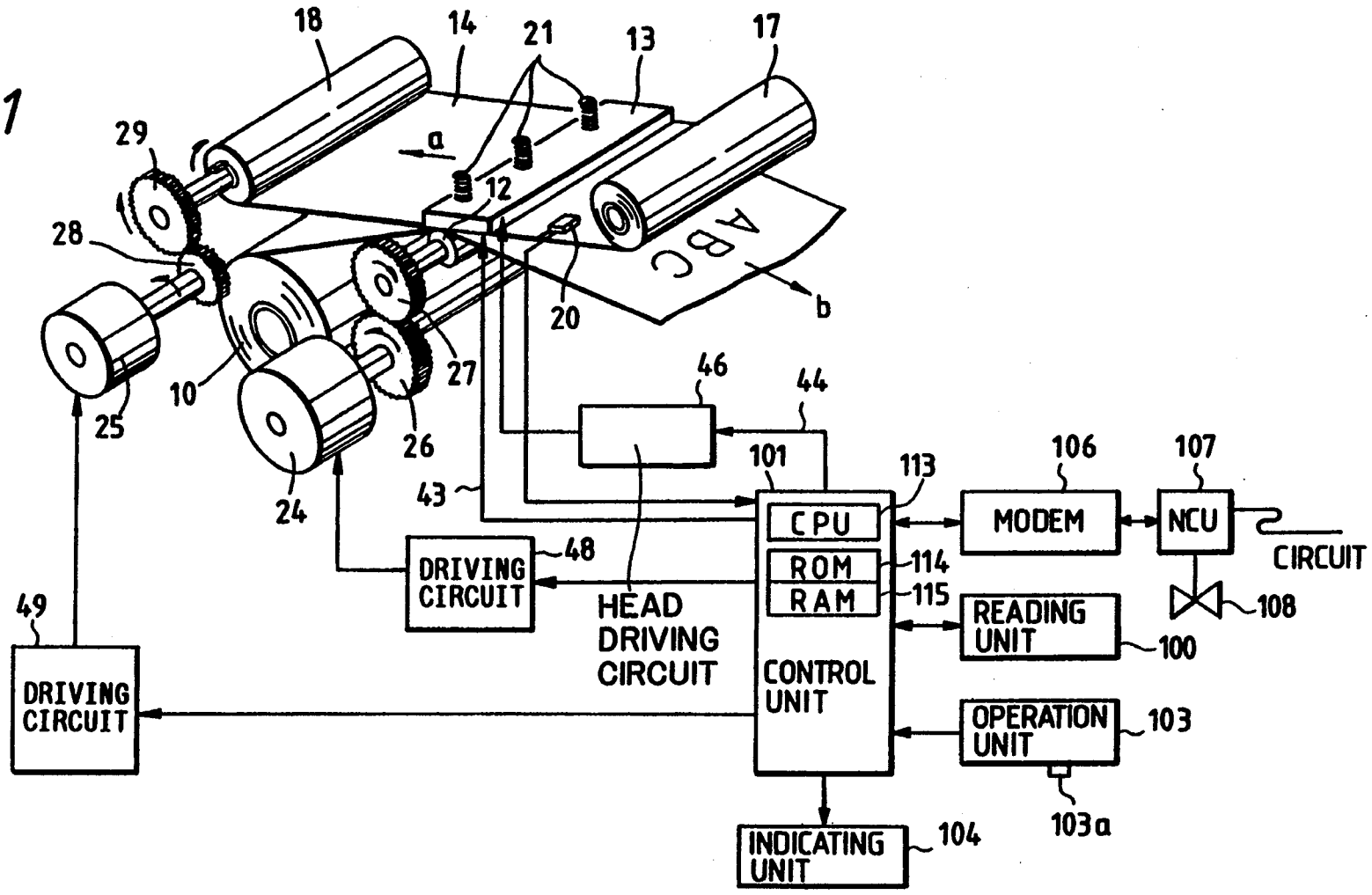
FIG. 1 is a block diagram showing a schematic arrangement of a facsimile apparatus and a conveying/-driving system of recording paper and an ink sheet.
Figure 2A:
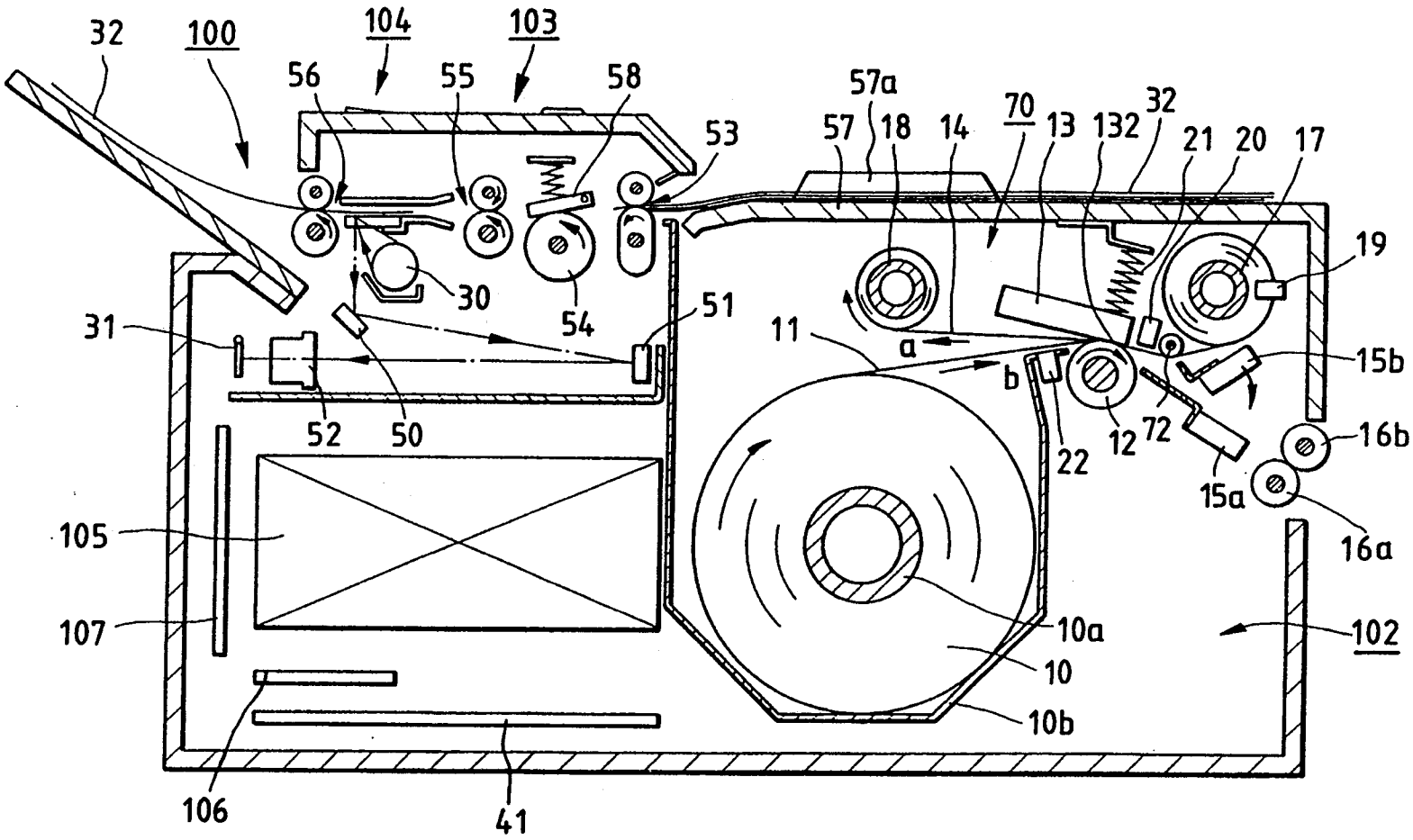
FIG. 2A is a side sectional view showing a mechanism of the facsimile apparatus shown in FIG. 1.
Figure 2B:
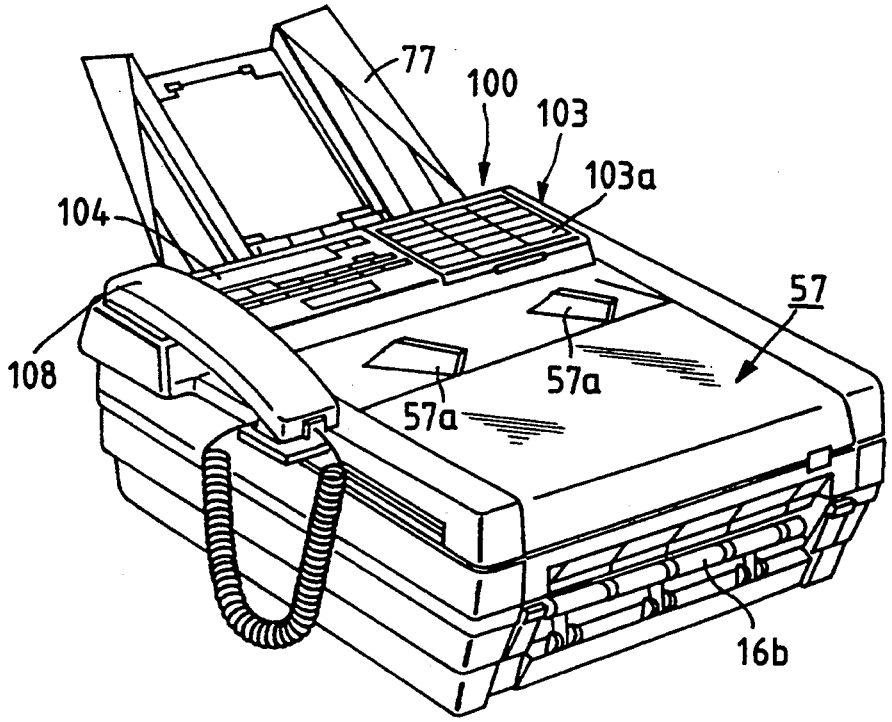
FIG. 2B is a perspective view showing an outer appearance of the facsimile apparatus shown in FIG. 1.

FIG. 1 is a block diagram showing a schematic arrangement in which a thermal transfer printer is applied to a facsimile apparatus according to an embodiment of the present invention, FIG. 2A is a side sectional view of the facsimile apparatus, and FIG. 2B is a perspective view showing an outer appearance of the facsimile apparatus.

The schematic arrangement will be described with reference to FIG. 1.

Referring to FIG. 1, an image reading unit 100 photoelectrically reads an original image and outputs the read image as a digital image signal to a control unit 101. The reading unit 100 includes an original conveying motor and a CCD image sensor. The control unit 101 controls the overall operation of the facsimile apparatus. More specifically, the control unit 101 encodes image data from the reading unit 100 and transmits the coded data through a modem (modulator/demodulator) 106 and an NCU (Network Control Unit) 107 having a repeater function for a telephone line. In the receiving mode, the control unit 101 decodes the coded image data into image data and outputs the image data to a recording unit including a thermal head 13, thereby reproducing image data. The control unit 101 includes a CPU 113 for outputting various control signals to control the overall operation of the apparatus in accordance with control programs stored in a ROM 114, the ROM 114 for storing the control programs of the CPU 113 and various data, and a RAM 115 serving as a work area of the CPU 113 to temporarily store various data.

An operation unit 103 includes various function keys (e.g., transmission start keys) and input keys (e.g., telephone number keys). A switch 103*a* is operated by an operator to designate the kind of ink sheet to be used. When the switch 103*a* is ON, the multi-print ink sheet is loaded. However, when the switch 103*a* is OFF, a normal one-time ink sheet is loaded. An indicating unit 104 is arranged in the operation unit 103 and indicates various functions and an apparatus state. A telephone set 108 is connected to the NCU 107.

Prior to a description of an arrangement of the recording unit, the facsimile apparatus will be described with reference to the side sectional view of FIG. 2A and the perspective view in FIG. 2B. The same reference numerals as in FIG. 1 denote the same parts in FIGS. 2A and 2B.

Referring to FIGS. 2A and 2B, recording paper 11 is wound around a core 10*a* to constitute a roll 10 of paper. The roll 10 is arranged to supply the recording paper 11 to the thermal head 13 upon rotation of a platen roller 12 in a direction indicated by an arrow. The roll 10 is mounted on a roll loading portion 10*b*. The roll loading portion 10*b* detachably receives the roll 10. The platen roller 12 conveys the recording paper 11 in a direction indicated by an arrow b. The platen roller 12 urges an ink sheet 14 and the recording paper 11 against heating resistance members 132 of the themal head 13. Upon heating of the thermal head 13, an image is recorded on the recording paper 11, and then the recording paper 11 is conveyed toward discharge rollers 16*a* and 16*b* upon further rotation of the platen roller 12, thereby completing one-page image recording. In this case, the recording paper is cut into page lengths by engagement of cutters 15*a* and 15*b*. The cut sheet is then discharge outside the facsimile apparatus.

The ink sheet 14 is wound around an ink sheet supply roller 17. The ink sheet 14 is then taken up by an ink sheet take-up roller 18. Upon driving of an ink sheet conveying motor 25, the ink sheet is taken up by the ink sheet take-up roller 18 and is conveyed in a direction opposite to the recording paper 11, i.e., in a direction indicated by an arrow a. The ink sheet supply roll 17 and the ink sheet take-up roller 18 are detachably loaded in an ink sheet loading portion 70. A sensor 19 detects the remaining amount and a conveying speed of the ink sheet 14. An ink sheet sensor 20 detects the presence/absence of the ink sheet 14. The thermal head 13 is urged against the platen roller 12 through the recording paper 11 and the ink sheet 14 by springs 21. A recording paper sensor 22 detects the presence/absence of the recording paper. A roller 72 guides the ink sheet 14.

The arrangement of the reading unit 100 will be described below.

Referring to FIGS. 2A and 2B, a light source 30 illuminates an original 32. Light reflected by the original 32 is input to a CCD sensor 31 through an optical system (i.e., mirrors 50 and 51 and a lens 52) and is converted into an electrical signal. The original 32 is conveyed by conveying rollers 53, 54, 55, and 56 driven by an original conveying motor (not shown) in correspondence with a reading speed of the original 32. A plurality of originals 32 placed on an original table 57 are guided by sliders 57*a*, are individually conveyed to the reading unit 100 by cooperation of a conveying roller 54 with a separating member 58, and are then discharged onto a tray 77 after image reading.

A control board 41 constitutes a main part of the control unit 101. The control board 41 outputs various control signals to the respective components of the facsimile apparatus. The facsimile apparatus also includes the modem 106 and the NCU 107.

The conveying system of the recording paper 11 and the ink sheet 14 in the recording unit is illustrated in detail in FIG. 1.

Referring to FIG. 1, the thermal head 13 comprises a line head for receiving one-line serial recording data and a latch signal from the control unit 101 through a signal line 43 and drives the heating elements consisting of one-line heating resistance members in a plurality of blocks, thereby perfoming one-line recording. A driving circuit 46 receives a driving signal for the thermal head 13 from the control unit 101 and outputs a strobe signal 44 for driving the thermal head 13 in units of blocks. Motor driving circuits 48 and 49 drive a recording paper conveying motor 24 and the ink sheet conveying motor 25, respectively. Transmission gears 26 and 27 transmit rotation of the recording paper conveying motor 24 to the platen roller 12. Transmission gears 28 and 29 transmit rotation of the ink sheet conveying motor 25 to the take-up roller 18. The recording paper conveying motor 24 and the ink sheet conveying motor 25 comprise stepping motors in this embodiment. However, the motors 24 and 25 are not limited to the stepping motors but can be replaced with DC motors.

When the conveying directions of the recording paper 11 and the ink sheet 14 are opposite to each other, a direction along which images are sequentially recorded in the longitudinal direction of the recording paper 11 (i.e., a direction indicated by the arrow a or a direction opposite to the conveying direction of the recording paper 11) is aligned with the conveying direction of the ink sheet. If a conveying speed $V_P$ of the recording paper 11 is defined as $V_P = -n \cdot V_I$ (where $V_I$ is the conveying speed of the ink sheet 14 and a negative sign indicates that the conveying direction of the recording paper 11 is opposite to that of the ink sheet 14), a relative speed $V_{PI}$ between the recording paper 11 and the ink sheet 14 when viewed from the thermal head 13 is defined as $V_{PI} = V_P - V_I = (1 + 1/n)V_P$ which is higher than the speed $V_P$, i.e., the relative speed $V_{PI}$, $(= (1 - 1/n)V_P)$ obtained by conveying them in the same direction as in the conventional case.

Referring to FIG. 1, a gear ratio of the transmission gears 26 and 27 is equal to that of the transmission gears 28 and 29. The ink sheet conveying motor 25 and the recording paper conveying motor 24 are stepping motors, respectively. At the same time, a minimum step angle of the ink sheet conveying motor 25 is $1/m$ $(m > 1)$ of a minimum step angle of the recording paper conveying motor 24.

When the recording paper conveying motor 24 is energized by one step, the recording paper 11 is conveyed by a length "L" in the direction indicated by the arrow a. To the contrary, when the ink sheet conveying motor 25 is energized by one step, the ink sheet 14 is conveyed by L/n'. The reason why the conveying length of the ink sheet 14 is not set to be L/m lies in the fact that the ink sheet conveying motor 25 drives the rotating shaft of the take-up roller 18 and the diameter of the take-up roller 18 is changed in accordance with a take-up amount of the ink sheet 14. When the diameter of the take-up roller 18 is increased to increase a conveying amount of the ink sheet 14 upon one-step energization of the ink sheet conveying motor 25, the ink sheet conveying motor 25 is driven in a microstep. That is, the ink sheet conveying motor 25 is driven by a smaller step angle, thereby controlling the conveying amount of the ink sheet 14.

[Description of Recording Operation (FIGS. 1 to 3)]

Figure 3A:
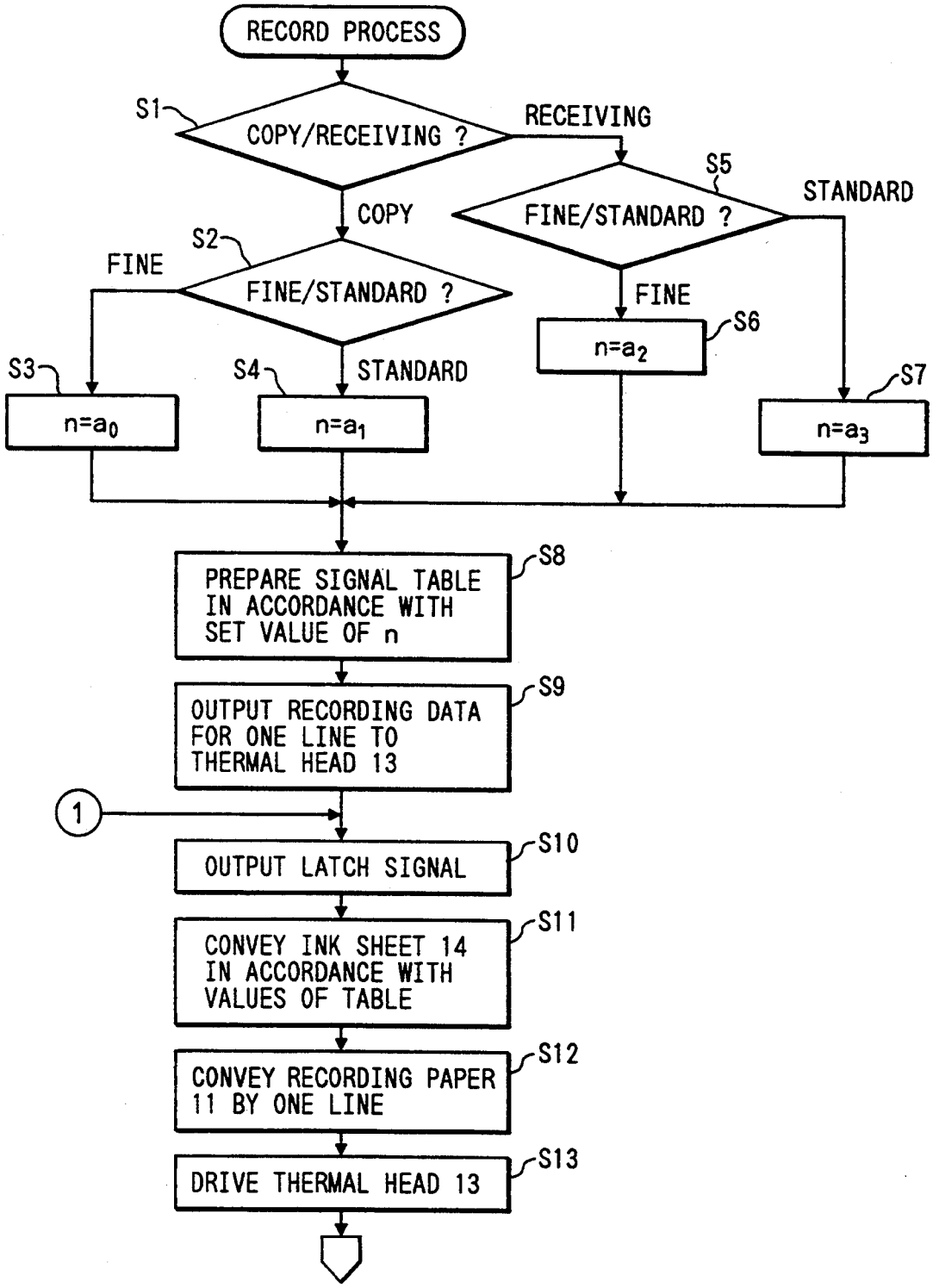
FIGS. 3A and 3B are flow charts showing recording processing of the facsimile apparatus shown in FIG. 1.
Figure 3B:
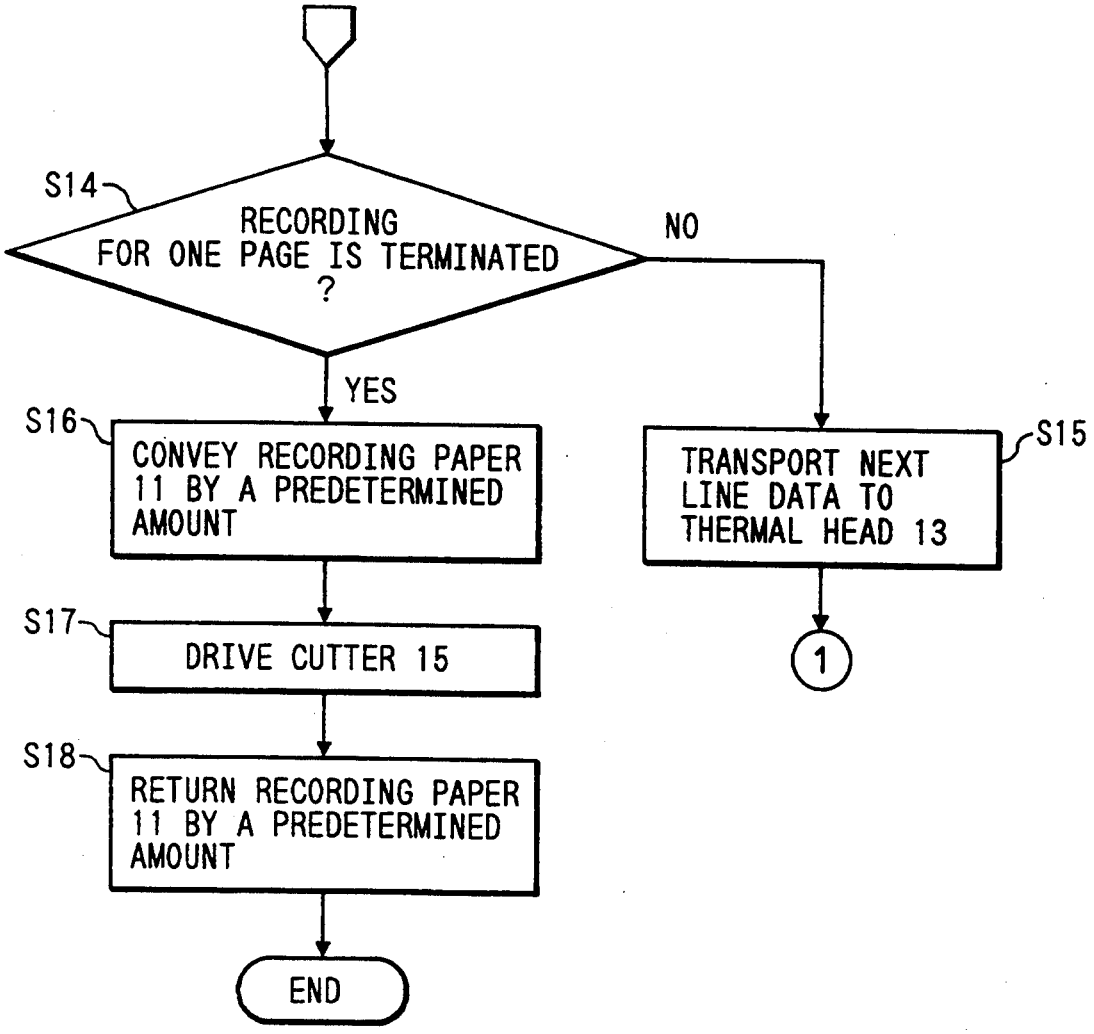

FIGS. 3A and 3B are flow charts showing recording operation of the facsimile apparatus shown in FIG. 1. The control program of the CPU 113 is stored in the ROM 114 of the control unit 101.

This processing is started upon image reception of the facsimile apparatus or image recording designation at the time of copying. In step S1, the CPU 113 determines whether image recording is based on copying or facsimile image reception. That is, the CPU 113 determines a copy mode in which an image corresponding to an original image read by the reading unit 100 is recorded on the recording paper 11 or a receiving mode in which an image corresponding to an original image transmitted from another facsimile apparatus is recorded on the recording paper 11. If the CPU 113 determines that image recording is based on copying, the flow advances to step S2. The CPU 113 determines in step S2 whether the mode is a fine mode (e.g., high-resolution recording of 3.5 mm in a subscanning direction) or a standard mode. If the CPU 113 determines that the present mode is the fine mode, the flow advances to step S3 to set the value n to "$a_0$". However, when the CPU 113 determines in step S2 that the present mode is the standard mode (e.g., standard recording of 3.85 mm in the subscanning direction), the flow advances to step S4 to set the value n to "$a_1$". The CPU 113 determines the present mode as the fine or standard mode in accordance with a control signal sent from the transmitting terminal in the preprocedures prior to reception of the image signal.

When the image reception is determined in step S1, the flow advances to step S5 to determine whether the present mode is the fine or standard mode. If the fine mode is determined, the flow advances to step S6 to set the value n to "$a_2$". However, when the CPU 113 determines in step S5 that the present mode is the standard mode, the flow advances to step S7 to set the value n to "$a_3$". In this manner, when the value n is determined, the flow advances to step S8. A table for determining the number of energization steps of the ink sheet conveying motor 25 and its energization phase is prepared on the basis of the determined value n, and the speed of the ink sheet conveying motor 25 is controlled in accordance with the value n. In this manner, the value n is determined in accordance with a recording density of an image and its recording cycle in this embodiment. However, the method of determining the value n is not limited to this. For example, the value n may be changed in accordance with the type of image data (e.g., a photographic original or a character original). The flow advances to step S9 to perform an image recording operation (to be described later). The type of image information to be recorded of reception image can be confirmed by the preprocedures in the control sequence. The type of recording image can be designated by a switch (not shown) in the copy mode.

In step S9, one-line image data is transferred to the thermal head 13. When one-line recording data transfer is completed, a latch signal is output in step S10 to latch one-line image data in the thermal head 13. In step S11, by referring to the table prepared in step S8, the ink sheet conveying motor 25 is driven to convey the ink sheet 14 by a (1/n) line in the direction indicated by arrow a in FIG. 1. In step S12, the recording paper conveying motor 24 is driven to convey the recording paper 11 by one line in the direction indicated by the arrow b. The one-line information corresponds to a length of one dot recorded by the thermal head 13.

The flow advances to step S13 to energize the thermal head 13 to heat it. When one-line image recording is completed, the flow advances to step S14. The CPU 113 determines in step S14 whether one-page image recording is completed. If NO in step S14, the flow advances to step S15. The image data of the next line is transferred to the thermal head 13, and the flow returns to step S10.

When one-page image recording is completed in step S14, the flow advances to step S16 to convey the recording paper 11 toward the discharge rollers **16*a* and 16*b* by a predetermined amount. In step S17, the cutters 15*a* and 15*b* are driven and engaged with each other to cut the recording paper 11 into page lengths. In step S18, the recording paper 11 is returned by a distance corresponding to a distance between the thermal head 13 and the cutter 15**, thereby completing one-page image recording.

In a series of cutting operations of the recording paper 11 in steps S16 to S18, the ink sheet 14 may be conveyed in a direction opposite to that of the recording paper 11 at a speed of $V_P/n$ in the same manner as in image recording during conveyance of the recording paper 11. The value n may be larger than that during image recording. In addition, the same behavior as the recording paper 11 may be performed by the platen roller 12, or the ink sheet 14 may be kept stationary.

[Description of Principle of Recording (FIG. 4)]

Figure 4:
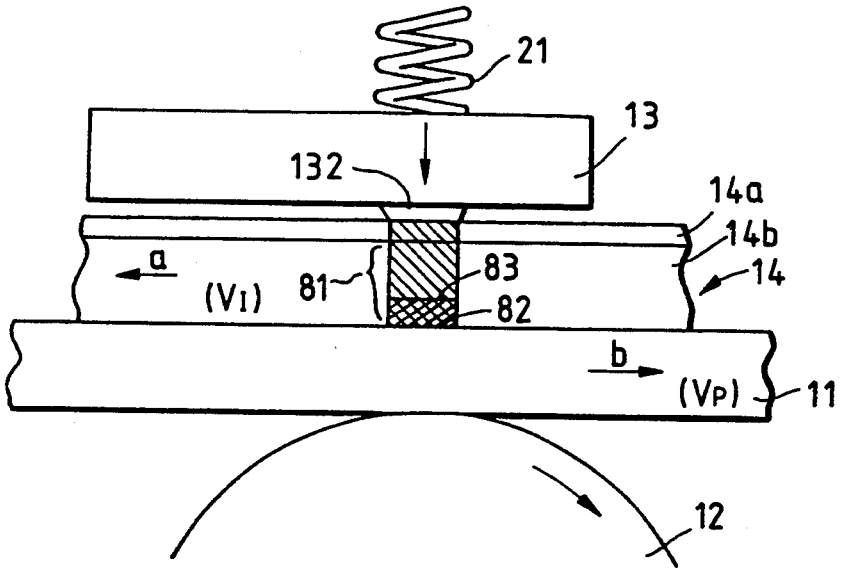
FIG. 4 is a view showing a structure of the ink sheet and a state of recording paper and the ink sheet during recording.

FIG. 4 is a view showing an image recording state in which the conveying directions of the recording paper 11 and the ink sheet 14 are opposite to each other in this embodiment (including respective embodiments to be described later).

As shown in FIG. 4, the recording paper 11 and the ink sheet 14 are sandwiched between the platen roller 12 and the thermal head 13, and the thermal head 13 is urged against the platen roller 12 by the springs 21 at a predetermined pressure. The recording paper 11 is conveyed in a direction indicated by the arrow b at a speed $V_P$ upon rotation of the platen roller 12. On the other hand, the ink sheet 14 is conveyed in the direction indicated by the arrow a at a speed $V_I$ upon rotation of the ink sheet conveying motor 25.

When the heating resistance members 132 of the thermal head 13 are energized and heated, a portion indicated by a hatched portion 81 of the ink sheet 14 is heated. The ink sheet 14 includes a base film **14*a* and an ink layer 14*b*. An ink of the ink layer 81 heated upon energization of the heating resistance members 132 is melted, and an ink layer portion 82 is transferred. The ink layer portion 82 corresponds to about 1/n of the ink layer 81**.

During ink transfer, a shearing force must act on the ink at a boundary 83 of the ink layer 14*b*, and only the ink layer portion 82 must be transferred to the recording paper 11. However, the shearing force varies depending on the temperature of the ink layer. When the ink layer has a higher temperature, the shearing force becomes smaller. When the heating time of the ink sheet 14 is shortened, the shearing force within the ink layer is increased. When the relative speed between the ink sheet 14 and the recording paper 11 is increased, the ink layer to be transferred can be satisfactorily separated from the ink sheet 14.

In this embodiment, since the heating time of the thermal head 13 in the facsimile apparatus is as short as about 0.6 ms, the relative speed between the ink sheet 14 and the recording paper 11 can be increased by setting opposite conveying directions of the ink sheet 14 and the recording paper 11.

In this embodiment, the conveying direction of the recording paper 11 is opposite to that of the ink sheet 14 during recording. However, the technique for increasing the relative speed between the ink sheet 14 and the recording paper 11 is not limited to the above technique. The ink sheet 14 and the recording paper 11 may be conveyed in the same direction.

[Description of Ink Sheet (FIG. 5)]

Figure 5:
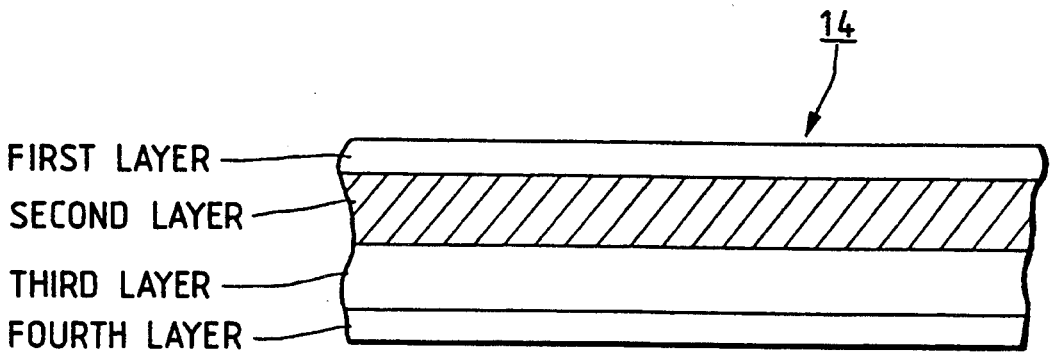
FIG. 5 is a sectional view of the ink sheet used in this embodiment.

FIG. 5 is a sectional view of an ink sheet used for a multi-print scheme of this embodiment (including the respective embodiments to be described later). The ink sheet has a four-layered structure.

The two layers constitute a base film serving as a support for the ink sheet 14. In a multi-print operation, since heat energy is repeatedly applied to each portion of the ink sheet 14, the base film is preferably made of an aromatic polyamide film or capacitor paper having a high heat resistance. However, a conventional polyester film may be used as the base film. The thickness of the base film is preferably small in favor of high printing quality. However, based on considerations of the mechanical strength, the thickness of the base film preferably falls within the range of 3 to 8 $\mu$m.

The third layer is an ink layer containing an ink in an amount for allowing ink transfer of n times to the recording paper (recording sheet). Ink layer components such as a resin (e.g., EVA) as an adhesive, carbon black or a nigrosine dye for coloring, and carnauba wax or paraffin wax as a binding material, all of which are major components, are mixed to allow repetitive use of n times at the same position. An application amount of the ink composition preferably falls within the range of 4 to 8 g/m$^2$. The application amount varies depending on sensitivity and density and can be arbitrarily selected.

The fourth layer is a top coating layer which does not contribute to printing and prevents pressure transfer of the ink of the third layer to the recording paper. The fourth layer consists of, e.g., a transparent wax layer. Therefore, the pressure-transferred layer is only the fourth transparent layer, thereby preventing background contamination of the recording paper. The first layer is a heat-resistive coating layer for protecting the second base film from heat from the thermal head 13. This is suitable for multi-print in which heat energy of n lines is applied to the same position (i.e., continuous black data). Use of the second film may be arbitrarily selected. The second film is very effective for a base film such as a polyester film having a relatively low heat resistance.

The structure of the ink sheet 14 is not limited to this embodiment. For example, the ink sheet may comprise a base layer and a porous ink holding layer formed on one surface of the base layer. Alternatively, a heat-resistive ink layer having a fine porous net structure may be formed on the base film, and an ink is contained in this ink layer. Examples of the base film are paper and a film made of, e.g., polyamide, polyethylene, polyester, polyvinyl chloride, triacetyl cellulose, or nylon. In addition, the heat-resistive coating layer is not always required. Examples of the heat-resistive coating layer may be a silicone resin, an epoxy resin, a fluoroplastic, or ethrocellulose.

An example of an ink sheet having a thermally sublimable ink is an ink sheet obtained by forming a color agent layer containing a dye and spacer particles of a guanamine resin and a fluoroplastic on a substrate made of a polyethylene terephthalate, polyethylene naphthalate, or aromatic polyamide film.

According to this embodiment as described above, the conveying speed of the ink sheet with respect to the recording paper can be appropriately changed in accordance with a recording state or image information such as type of image data and its characteristics. In a facsimile apparatus, for example, the relative speed between the ink sheet and the recording paper is changed in accordance with a display mode or a fine mode when equi-speed recording and intermittent recording are performed. Therefore, formation of wrinkles of the ink sheet and degradation of image recording quality can be prevented.

This embodiment exemplifies a facsimile apparatus. However, the present invention is not limited to this. The thermal transfer recording apparatus of the present invention can also be applied to a wordprocessor, a typewriter, or a copying machine.

Another embodiment of the present invention will be described with reference to FIGS. 6 to 10.

The same reference numerals as in the previous embodiments denote the same parts in this embodiment, and a detailed description thereof will be omitted.

Figure 6:
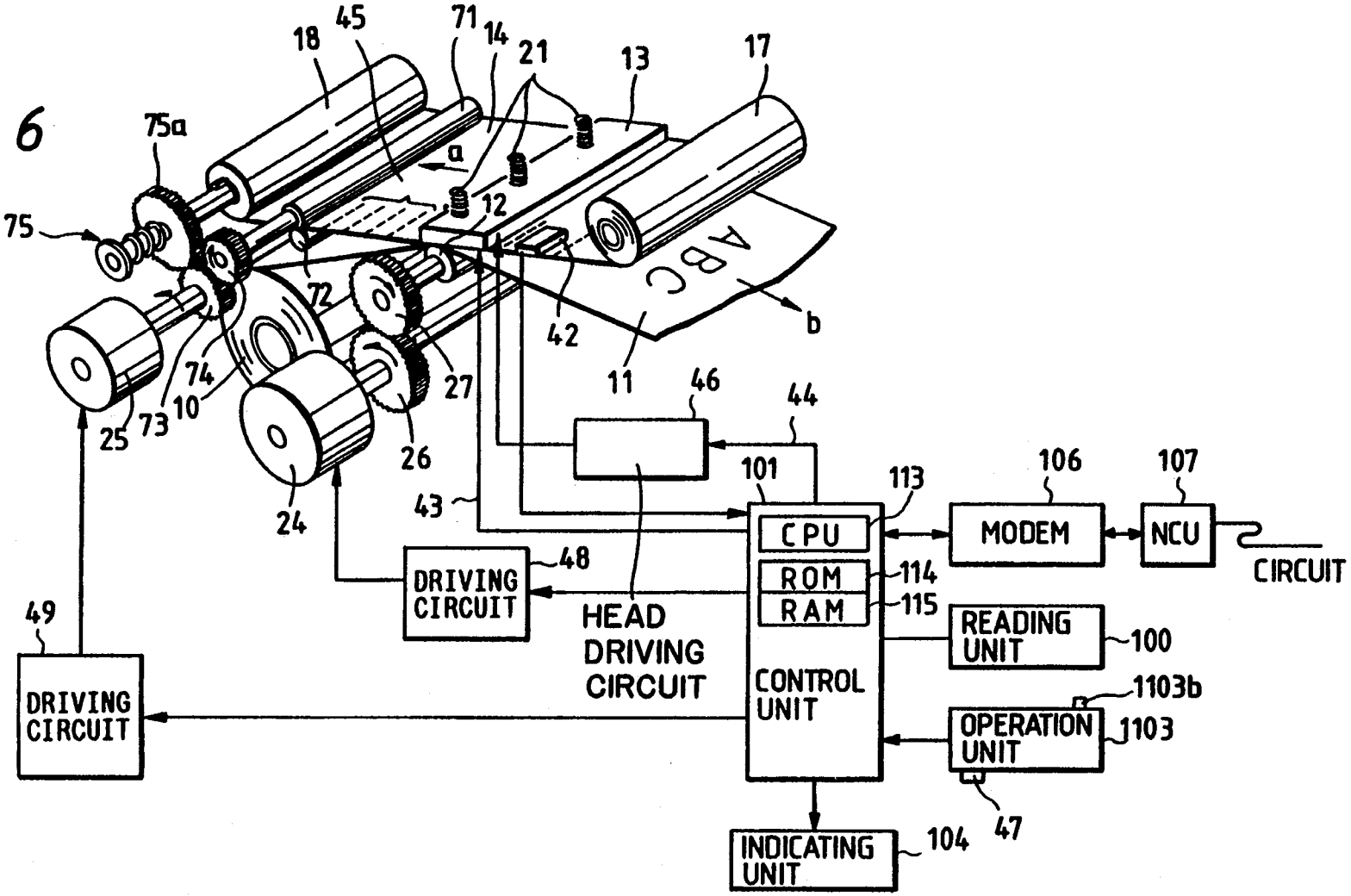
FIG. 6 is a block diagram showing a schematic arrangement of a facsimile apparatus and a conveying/-driving system of recording paper and an ink sheet according to another embodiment of the present invention.
Figure 7:
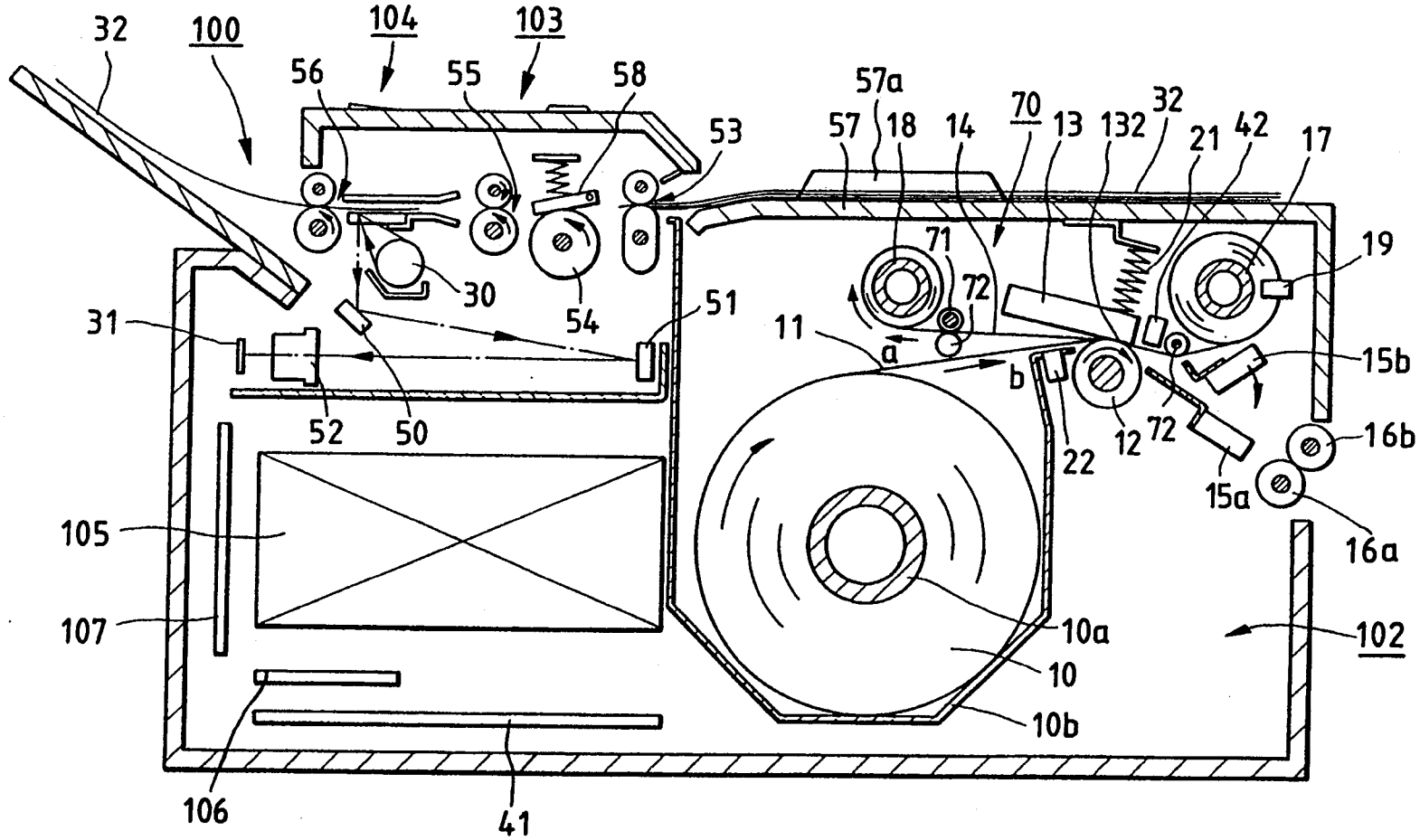
FIG. 7 is a side sectional view showing a mechanism of the facsimile apparatus shown in FIG. 6.

FIG. 6 is a block diagram showing a schematic arrangement in which a thermal transfer printer is applied to a facsimile apparatus, and FIG. 7 is a side sectional view of the facsimile apparatus.

An operation unit 1103 includes various function keys (e.g., a transmission start key) and input keys (e.g., telephone number keys). More specifically, the operation unit 1103 includes a key 47 such as a DIP switch for setting the number of multi-print cycles and a saving switch 1103*b* (to be described later). A capstan roller 71 and a pinch roller 72 are driven by an ink sheet conveying motor 25 to convey an ink sheet 14 in a direction indicated by an arrow a, i.e., in a direction opposite to recording paper 11. A take-up roller 18 is driven by the ink sheet conveying motor 25 to take up the ink sheet 14 conveyed by the rollers 71 and 72.

FIG. 6 shows a conveying system of the recording sheet 11 and the ink sheet 14 in the recording unit. The conveying system includes reduction gears 73 and 74 and a slip clutch unit 75. When the ink sheet conveying motor 25 and a recording paper conveying motor 24 are driven, the number n of multi-print cycles can be determined by appropriately setting a value of a reduction ratio $i_I$ of the reduction gears 73 and 74 and a value of a reduction ratio $i_P$ of gears 26 and 27. When the gear 73 is meshed with a gear 75*a* of the slip clutch 75, the take-up roller 18 can take up the ink sheet 14 conveyed by the capstan roller 71 and the pinch roller 72.

When a ratio of the gear 74 to the gear 75*a* is determined such that the length of the ink sheet 14 taken up by the take-up roller 18 upon rotation of the gear 75*a* is longer than the length of the ink sheet conveyed by the capstan roller 71, the ink sheet 14 conveyed by the capstan roller 71 can be satisfactorily taken up by the take-up roller 18. A difference between the take-up amount of the ink sheet 14 by the take-up roller 18 and the ink sheet 14 conveyed by the capstan roller 71 is absorbed by the slip clutch unit 75. Therefore, variations in conveying speed of the ink sheet 14 caused by a change in take-up diameter of the take-up roller 18 can be prevented.

The number of multi-print cycles can be set with the key 47 on the operation unit 1103. However, a mark or the like on the ink sheet 14 may be read to set the number of multi-print cycles. A photosensor 42 reads the mark representing the number of multi-print cycles from the ink sheet 14. A mark 45 representing an appropriate number of multi-print cycles is printed near the end portion on the lower surface of the ink sheet 14. In this embodiment, the mark consists of dot data. The number of dots represents the number of multi-print cycles. This dot pattern may be represented by binary notation.

Figure 8:
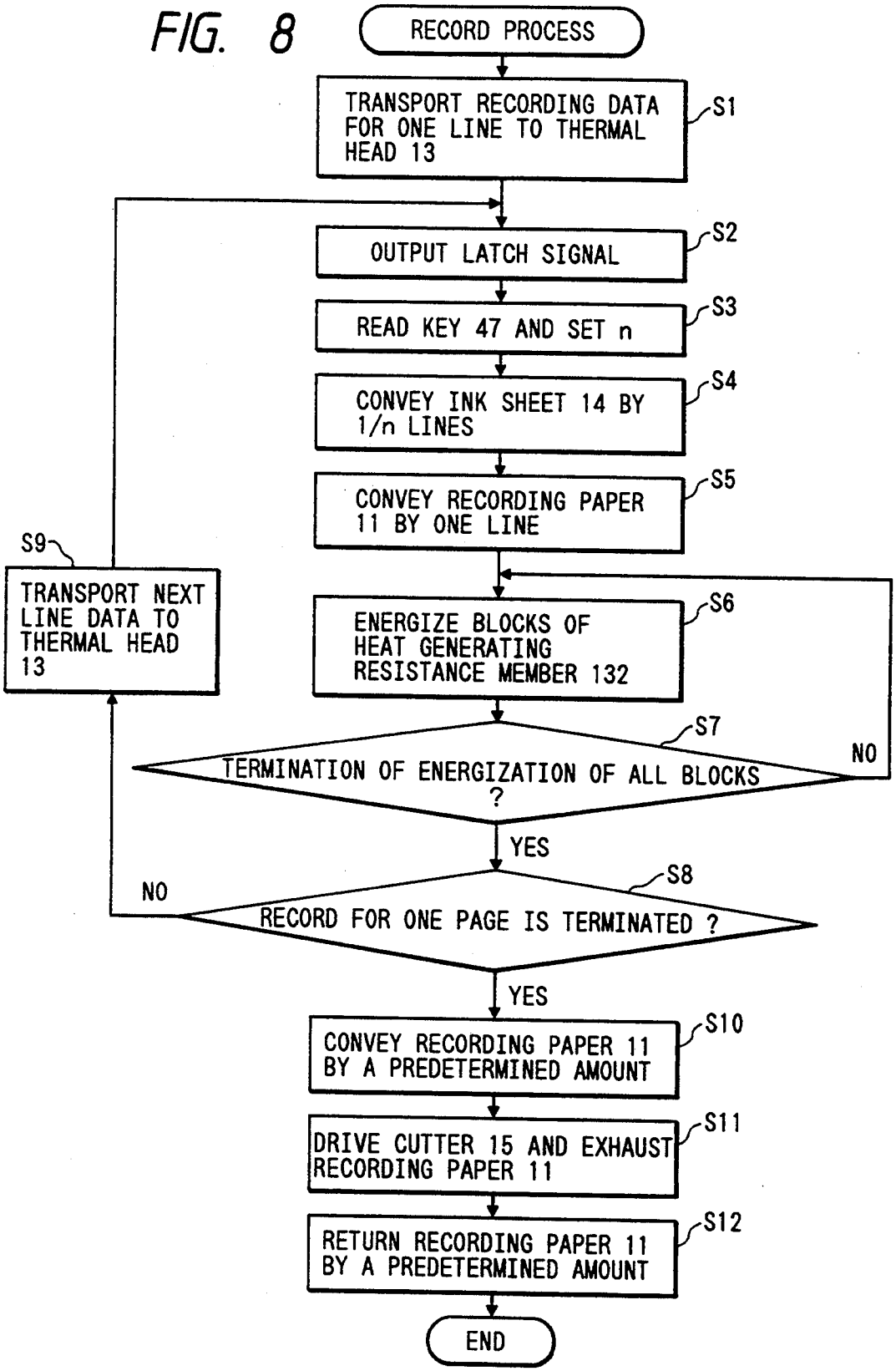
FIG. 8 is a flow chart showing recording processing of the facsimile apparatus shown in FIG. 6.

FIG. 8 is a flow chart showing one-page recording in the facsimile apparatus of this embodiment. A control program for executing this processing is stored in a ROM 114 of a control unit 101.

This processing can be started when one-line image data is stored in the control unit 101 and a recording operation is ready to start. In step S1, one-line serial recording data is output to a thermal head 13. When one-line recording data transfer is completed, a latch signal is output in step S2 to store the one-line recording data in a latch circuit in the thermal head 13. In step S3, a value designated by the key 47 on the operation unit 1103 is read to set the number n of multi-print cycles.

The flow advances to step S4 to drive the ink sheet conveying motor 25 to convey the ink sheet 14 by a (1/n) line in a direction indicated by an arrow a in FIG. 6. In step S5, the recording paper conveying motor 24 is driven to convey the recording paper 11 by one line in a direction indicated by an arrow b. The one-line length is set to be, e.g., about 1/15.4 mm in the facsimile apparatus. The conveying amounts of the recording paper 11 and the ink sheet 14 can be set by changing the numbers of pulses for energizing the motors 24 and 25.

Assume that each of the recording paper conveying motor 24 and the ink sheet conveying motor 25 is driven in 1–2 phase energization, that the recording paper 11 is conveyed by one line every energization cycle, and that the ink sheet 14 is conveyed by the same length as that of the recording paper 11 by 20 energization cycles. If the number of multi-print cycles is 5 and the recording sheet is conveyed by one line, the ink sheet 14 is conveyed by 1/5 line by four energization cycles, and its conveying distance is $1/(15.4\times5)$ mm.

The flow then advances to step S6 to energize each block of heating elements 132 of the thermal head 13. A CPU 113 determines in step S7 whether all the blocks are energized. When all the blocks of the heating elements 132 are energized to complete one-line image recording, the flow advances to step S8 to check whether one-page image recording is completed. If NO in step S8, the flow advances to step S9, recording data of the next line is transported or transferred to the thermal head 13, and the flow returns to step S2.

When one-page image recording is completed in step S8, the flow advances to step S10 to convey the recording paper 11 toward discharge rollers 16*a* and 16*b* by a predetermined amount. In step S10, cutters 15*a* and 15*b* are driven and engaged with each other to cut the recording paper 11 into page lengths. In step S12, the recording paper 11 is returned by a distance corresponding to a distance between the thermal head 13 and the cutter 15, thereby completing one-page image recording processing.

In a series of cutting operations of the recording paper 11 by the cutter 15 in steps S10 to S12, the ink sheet may be conveyed in a direction opposite to that of the recording paper 11 at a speed of $V_P/n$ as in recording. The value n may be larger than that during recording. The same operation as the recording paper 11 may be performed by the platen roller 12, or the ink sheet may be kept stopped.

Figure 9:
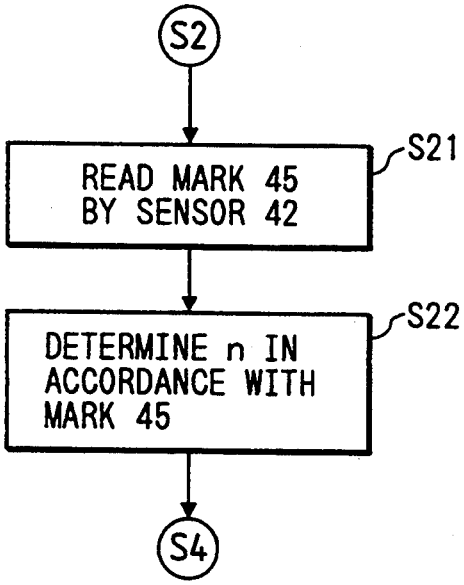
FIG. 9 is a flow chart showing processing for reading an ink sheet mark and setting a value n according to still another embodiment of the present invention.

An operation for causing the photosensor 42 to read the mark 45 from the ink sheet 14 and set the number n of multi-print cycles will be described with reference to a flow chart in FIG. 9.

Only steps corresponding to step S3 of the flow chart of FIG. 8 are illustrated, and other steps are omitted since they are the same as those of FIG. 8.

After a latch signal is output in step S2, the mark 45 is read in step S21 on the basis of the signal from the photosensor 42. In step S22, the number n of multi-print cycles is determined on the basis of the value of the mark 45. The flow then advances to step S4, and the same operations as in the flow chart of FIG. 8 are performed.

The saving switch 1103*b* is arranged in the operation unit 1103 shown in FIG. 6 to set a mode for saving the ink sheet 14.

Figure 10:
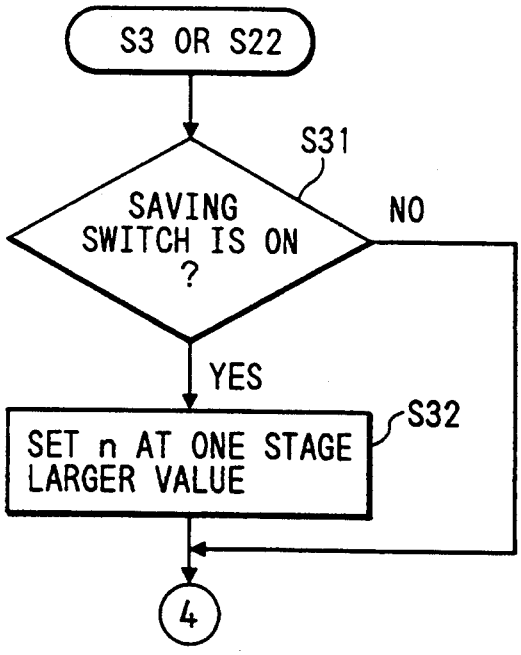
FIG. 10 is a flow chart showing processing when a saving switch is arranged according to still another embodiment of the present invention.

FIG. 10 is a flow chart showing ink sheet saving processing. When the saving switch 1103*b* is depressed in step S31, the flow advances to step S32. The value n is increased to be larger than the value n designated by the switch 47 in step S3 or the value n represented by the mark 45 of the ink sheet 14 in steps S21 and S22. Therefore, the convey amount of the ink sheet 14 conveyed during one-line image recording can be reduced, and the number of multi-print cycles for the predetermined length of the ink sheet 14 is increased, thereby saving the ink sheet 14. In this case, the image recording density may be slightly decreased.

According to this embodiment as has been described above, the relative conveying distance between the recording paper and the ink sheet is changed to change the number of multi-print cycles for the predetermined length of the ink sheet. Therefore, the number of multi-print cycles can be arbitrarily set.

According to this embodiment, the number of multi-print cycles can be automatically set in accordance with the mark formed on the ink sheet.

Furthermore, according to the present invention, since the number of multi-print cycles larger than that designated by the mark on the ink sheet or by the operation unit can be designated, the consumption of the ink sheet can be reduced.

This embodiment exemplifies a case using a thermal line head, but is not limited thereto. For example, the same ink ribbon having the same material as that of the ink sheet as described in this embodiment and a serial head are used to perform multi-printing. More specifically, the take-up amount of the ink ribbon mounted on a carriage is changed in a direction for moving the carriage (i.e., a recording direction) in accordance with the switch 47 and the type of ink sheet, thereby performing multi-printing by a predetermined number of times. In this case, for example, when the carriage is moved to the right, the ink ribbon is conveyed from the left to the right with respect to the thermal head.

In this embodiment, the number of multi-print cycles of the ink sheet is designated by the mark formed on the lower surface of the ink sheet, but is not limited to this. The number of multi-print cycles may be designated by a mark printed on an ink cartridge for storing an ink sheet, or a notch or projection formed on a cartridge or cassette.

According to the embodiments (FIGS. 6 to 10) as described above, the number of multi-print cycles can be arbitrarily determined, and the conveying distance of the ink sheet with respect to the recording medium can be changed in accordance with the determined number. Therefore, image recording can be performed with an arbitrary number of multi-print cycles.

According to the present invention, the number of multi-print cycles can be automatically determined in accordance with the properties and types of ink sheets.

Other embodiments of the present invention will be described with reference to FIGS. 11 to 15.

This embodiment exemplifies an operation wherein the remaining amount of an ink sheet is detected by a detecting means, and whether or not recording information can be recorded by the remaining amount of the ink sheet is determined in consideration of the amount of the ink sheet and the recording information. When it is determined that the recording information cannot be recorded due to a lack of sufficient ink sheet, the conveying amount of ink sheet is reduced, thus controlling conveyance of the ink sheet. In addition, another embodiment exemplifies an operation for detecting the remaining amount of the ink sheet and displaying the detected amount on a displaying means. A means for conveying the ink sheet is controlled in correspondence with a value n input from an input means in consideration of the displayed remain.

A facsimile apparatus employing the present invention will be described with reference to FIGS. 11 to 13.

Figure 11:
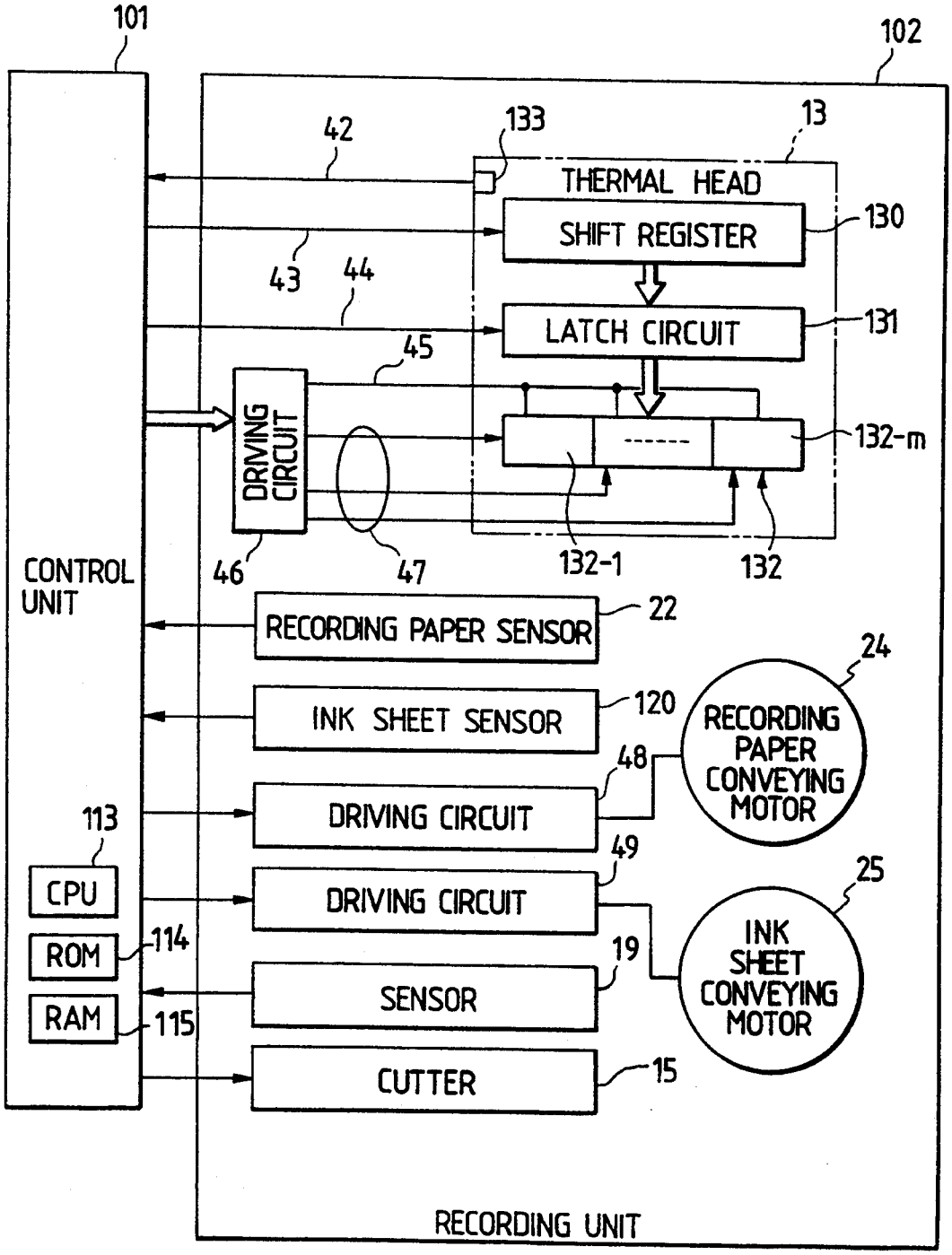
FIG. 11 is a view showing electrical connections of a control unit and a recording unit in a facsimile apparatus according to still another embodiment of the present invention.
Figure 12:
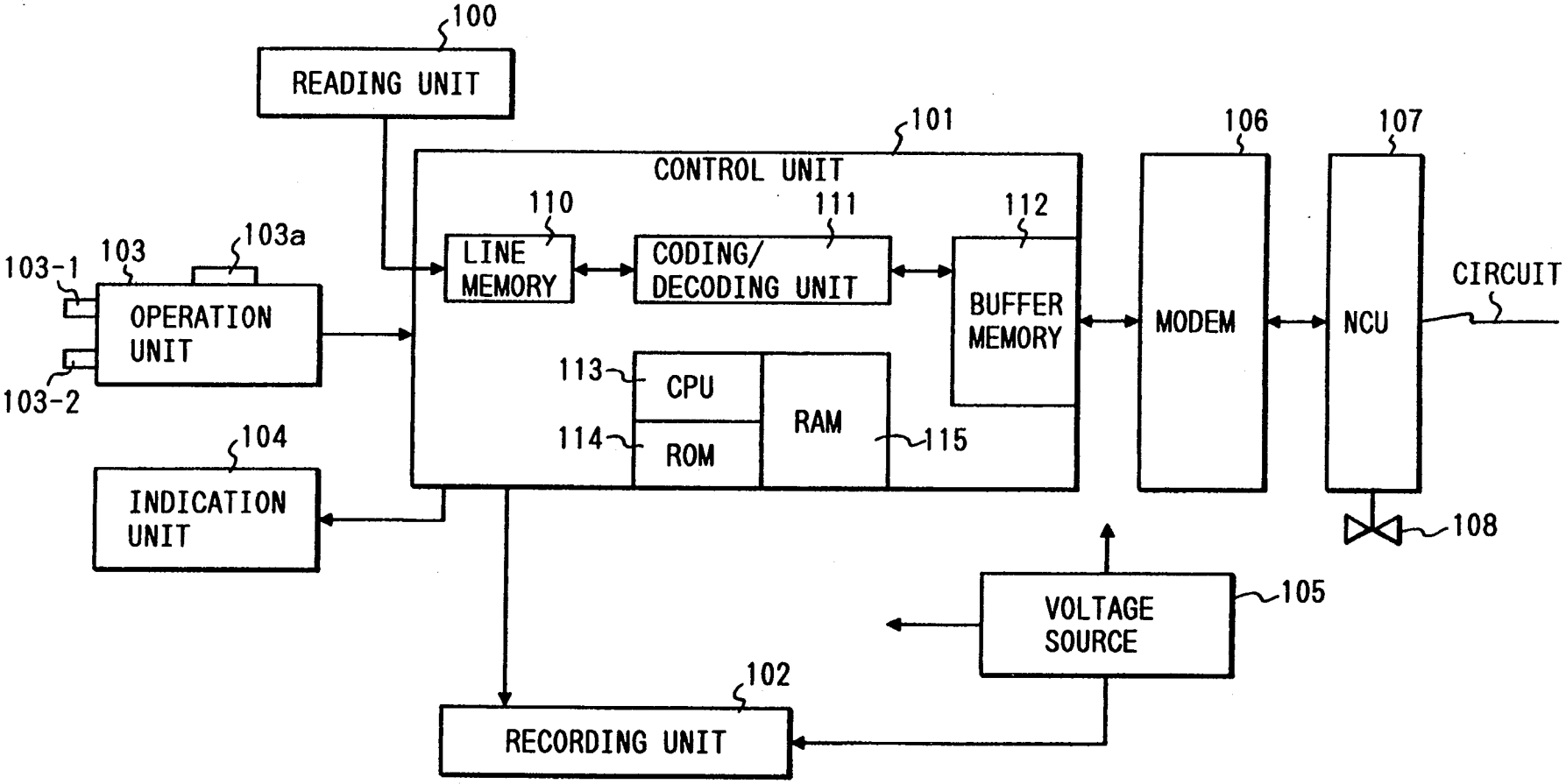
FIG. 12 is a block diagram showing a schematic arrangement of the facsimile apparatus shown in FIG. 11.

FIGS. 11 and 12 show an arrangement in which a thermal transfer printer is used in a facsimile apparatus. More specifically, FIG. 11 is a view showing electrical connections between a control unit and a recording unit, and FIG. 12 is a block diagram showing a schematic arrangement of the facsimile apparatus. The side section of the facsimile apparatus will be described with reference to FIG. 2A.

The schematic arrangement of the facsimile apparatus will be described with reference to FIG. 12.

Referring to FIG. 12, a reading unit 100 photoelectrically reads an original image and outputs the read image to a control unit 101 as a digital image signal. The reading unit 100 includes an original conveying motor and a CCD image sensor. The control unit 101 includes a line memory 110 for storing one-line image data. One-line image data is supplied from the reading unit 100 to the line memory 110 and is stored in the line memory 110 in an original transmitting mode or a copy mode. In an image data receiving mode, one-line decoded image data is stored in the line memory 110. The data stored in the line memory 110 is output to a recording unit 102 to perform image formation. A coding/decoding unit 111 codes transmitting image information in accordance with MH coding and decodes the received encoded image data into image data. The control unit 101 also includes a buffer memory 112 for storing the transmitting or received coded image data. The line memory 110, the buffer memory 112, and the coding/decoding unit 111 are controlled by a CPU 113 such as a microprocessor. In addition to the CPU 113, the control unit 101 also includes a ROM 114 for storing control programs of the CPU 113 and various data, and a RAM 115 serving as a work area for temporarily storing various data.

The recording unit 102 comprises a thermal line head and performs image recording on recording paper in accordance with a thermal transfer recording method. The arrangement of the recording unit 102 will be described with reference to FIG. 11 later. An operation unit 103 includes various function keys (e.g., a transmission start key) and input keys (e.g., a telephone number key). More specifically, the operation unit 103 includes a switch 103-1 for designating whether a conveying amount of an ink sheet is adjusted. For example, when the switch 103-1 is ON, a value n is automatically changed. The operation unit 103 also includes a switch 103-2 for designating a conveying amount of the ink sheet with respect to recording paper. The switch 103-2 comprises, e.g., a digital switch. The operation unit 103 further includes a switch **103*a* for designating the type of ink sheet to be used. When the switch 103*a* is ON, the multi-print ink sheet is set. However, when the switch 103*a* is OFF, a normal ink sheet is set. An indicating unit 104 is arranged in the operation unit 103 to indicate various functions, a state of the apparatus, and the remain of the ink sheet. A voltage source 105 supplies a voltage to the respective components of the apparatus. The facsimile apparatus also includes a modem (modulator/demodulator) 106, an NCU (Network Control Unit) 107, and a telephone set 108**.

Figure 13:
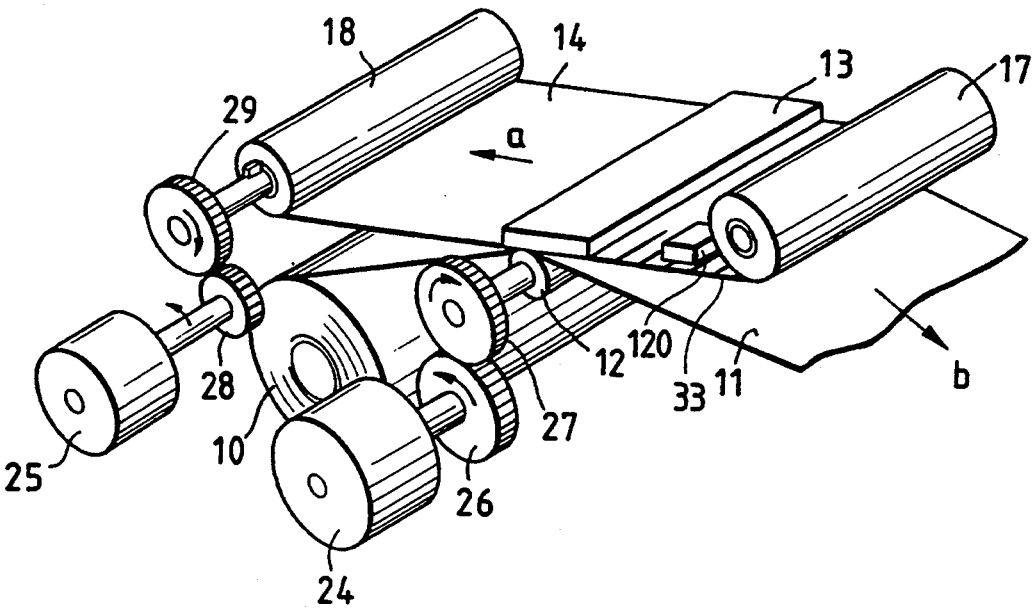
FIG. 13 is a view showing a structure of a conveying system of an ink sheet and recording paper.
Figure 15:
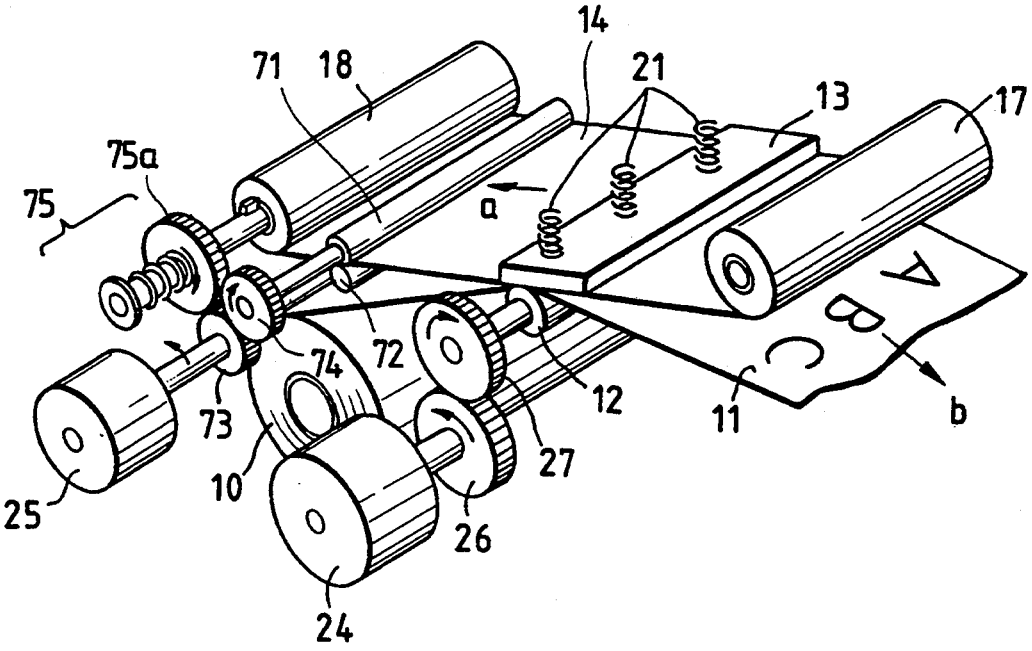
FIG. 15 is a view showing a structure of a conveying system of an ink sheet and recording paper according to still another embodiment of the present invention.

FIG. 13 is a view showing a detailed structure of a conveying mechanism for an ink sheet 14 and recording paper 11.

Referring to FIG. 13, a recording paper conveying motor 24 drives a platen roller 12 to convey the recording paper 11 in a direction of an arrow b opposite to a direction of an arrow a. An ink sheet conveying motor 25 conveys the ink sheet 14 in the direction indicated by the arrow a. Transmission gears 26 and 27 transmit rotation of the recording paper conveying motor 24 to the platen roller 12. Gears 28 and 29 transmit rotation of the ink sheet conveying motor 25 to a take-up roller 18. An ink sheet sensor 120 detects the presence/absence of the ink sheet 14 and the remaining amount of the ink sheet 14 on the basis of a mark formed on the ink sheet 14. The ink sheet sensor 120 reads a mark 33 formed on the ink sheet 14 and detects the remaining amount of the ink sheet 14. The mark 33 may represent remaining count data printed as, e.g., a bar code. The remaining count data represents how many A4 sheets can be printed from now on. Alternatively, for example, if 20 marks 33 are formed, the number of marks is counted to detect a remaining length in meters or millimeters.

When the conveying directions of the recording paper 11 and the ink sheet 14 are opposite to each other, a direction along which images are sequentially recorded in the longitudinal direction of the recording paper 11 (i.e., a direction indicated by the arrow a or a direction opposite to the conveying direction of the recording paper 11) is aligned with the conveying direction of the ink sheet. If a conveying speed $V_P$ of the recording paper 11 is defined as $V_P = -n \cdot V_I$ (where $V_I$ is the conveying speed of the ink sheet 14 and a negative sign indicates that the conveying direction of the recording paper 11 is opposite to that of the ink sheet 14), a relative speed $V_{PI}$ between the recording paper 11 and the ink sheet 14 when viewed from the thermal head 13 is defined as $V_{PI} = V_P - V_I(1+1/n)V_P$, which is higher than the speed $V_P$, i.e., the relative speed $V_{PI}$, $(=(1-1/n)V_P)$ obtained by conveying them in the same direction as in the conventional case.

Other methods are also available. For example, when n-line image recording is performed with the thermal head 13, the ink sheet 14 is conveyed in the direction indicated by the arrow a by (l/m) (where m is an integer which satisfies $n>m$) every (n/m) lines. According to another method, when recording with a distance corresponding to a length L is to be performed, the ink sheet 14 is conveyed in the direction opposite to that of the recording paper 11 at the same speed during recording. Prior to recording of the next predetermined amount, the ink sheet 14 is returned by $L \cdot (n-1)/n$ (where $n>1$). In either method, the relative speed during recording while the ink sheet 14 is kept stopped is given as $V_P$, and the relative recording speed while the ink sheet 14 is kept moved is given as $(1+1/n)V_P$.

FIG. 11 is a view showing the electrical connections between the control unit 101 and the recording unit 102 in the facsimile apparatus. The same reference numerals as in FIGS. 12 and 13 denote the same parts in FIG. 11.

The thermal head 13 is a line head. The thermal head 13 comprises a shift register 130 for inputting one-line serial recording data 43 from the control unit 101, a latch circuit 131 for latching the data from the shift register 130 in response to a latch signal 44, and heating elements 132 consisting of one-line heating resistance members. The heating resistance members 132 are driven in m blocks 132-1 to 132-m. A temperature sensor 133 is mounted on the thermal head 13 to detect a temperature of the thermal head 13. An output signal 42 from the temperature sensor 133 is converted from an analog signal into a digital signal by the control unit 101. The digital signal is then input to the CPU 113. The CPU 113 detects the temperature of the thermal head 13 on the basis of this digital signal, changes a pulse width of a strobe signal 47 in correspondence with the detected temperature, changes a driving voltage for the thermal head 13, and changes energy applied to the thermal head 13 in accordance with the properties of the ink sheet 14.

The properties (types) of the ink sheet 14 are designated by the switch 103*a*. The types and properties of the ink sheet 14 may be determined by detecting a mark printed on the ink sheet 14. Alternatively, the types and properties can be determined by detecting a mark, a notch, or a projection formed on a cartridge or cassette of the ink sheet.

A driving circuit 46 inputs a driving signal for the thermal head 13 and outputs the strobe signal 47 for driving the thermal head 13 in units of blocks. The driving circuit 46 changes the voltage output to a voltage line 45 for supplying a current to the heating elements 132 of the thermal head 13 in response to designation from the control unit 101, thereby changing energy applied to the thermal head 13. Motor driving circuits 48 and 49 drive the recording paper conveying motor 24 and the ink sheet conveying motor 25, respectively. The recording paper conveying motor 24 and the ink sheet conveying motor 25 are stepping motors, respectively, in this embodiment, but are not limited thereto. These motors 24 and 25 may be, e.g., DC motors.

Figure 14A:
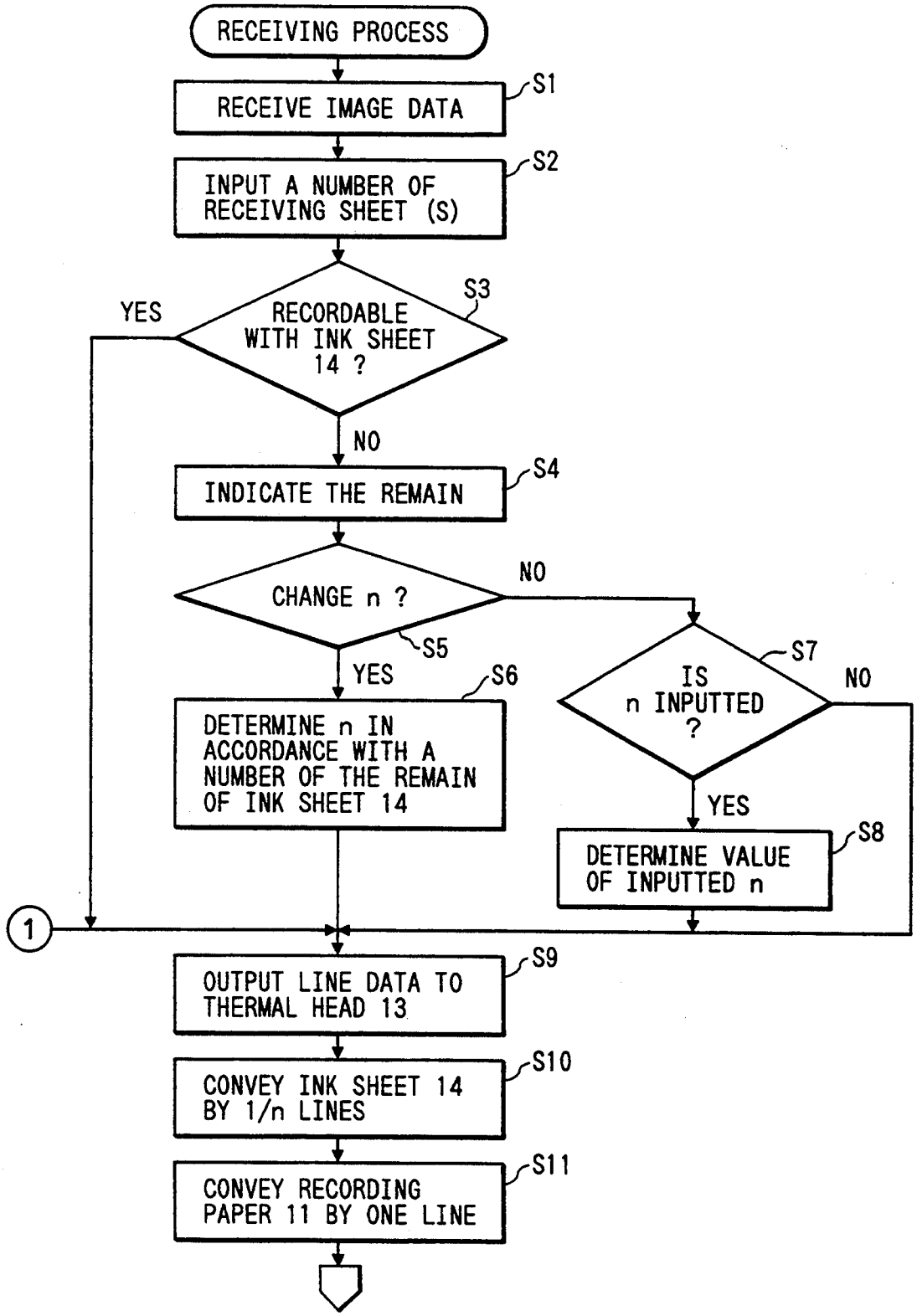
FIGS. 14A and 14B are flow charts showing receiving processing in the facsimile apparatus shown in FIG. 11.
Figure 14B:
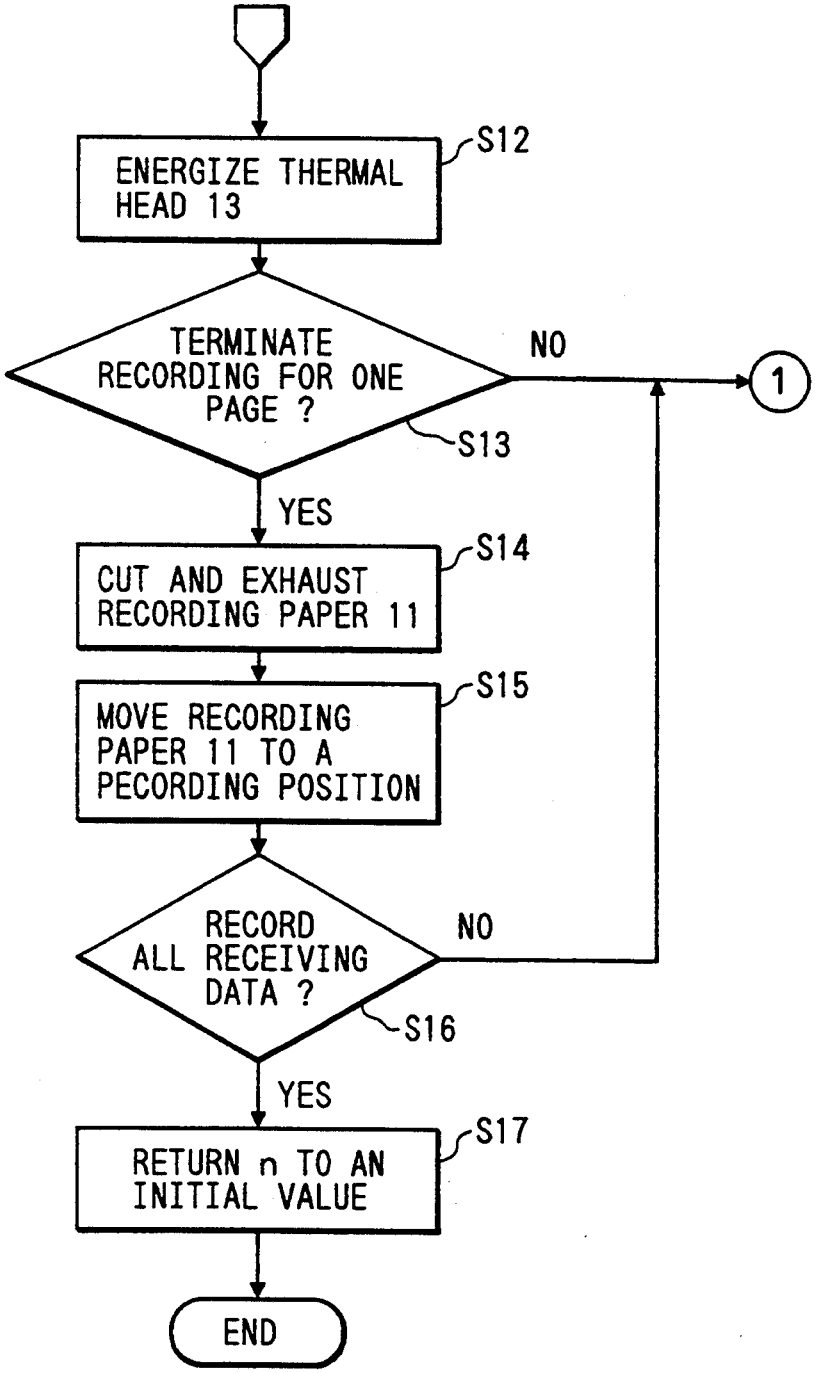

A recording operation of this embodiment will be described below. FIGS. 14A and 14B are flow charts showing receiving processing of the facsimile apparatus. The control program for executing this processing is stored in the ROM 114 of the control unit 101.

This processing is started upon reception of a facsimile image signal. In step S1, the image data encoded and converted into image data is stored in the line memory 110. In step S2, the number of input receiving sheets is counted. Based on the remaining amount of the ink sheet 14 which is detected by the photosensor 120 and the number of input receiving sheets detected in step S2, the CPU 113 determines in step S3 whether all the image data can be recorded by the remaining amount of the ink sheet 14. If YES in step S3, the flow advances to step S9. However, if NO in step S3, the flow advances to step S4 to indicate the remaining amount of the ink sheet 14 on the indicating unit 104. The remainder indication may be always provided regardless of the recording enable/disable state.

Whether the value n is changed is determined in accordance with a state of the switch 103-1 in step S5. If the value n can be changed, the flow advances to step S6 to increase the value n in accordance with the remaining amount of the ink sheet 14 and the number of input receiving sheets. Therefore, the conveying length of the ink sheet 14 with respect to the predetermined conveying length of the recording paper 11 can be decreased, so that the number of multi-print cycles of the ink sheet 14 can be increased. However, if the change in value n is not determined in step S5, the flow advances to step S7 to determine whether the value n is designated by the switch 103-2. If YES in step S7, the flow advances to step S8 to store the present value as the value n.

As is apparent from an ink ribbon generally used in a wire-dot printer, when the number of multi-print cycles of the multi-strike ribbon is increased, the recording density is decreased. However, a non-recording state is not immediately set. Similarly, when thermal transfer recording is performed using a multi-print ink sheet, and recording of all received images takes priority over recording quality, the operator changes the value n upon operation of the switch 103-1 or the switch 103-2, thereby increasing the number of multi-print cycles of the ink sheet 14.

The flow then advances to step S9 to output one-line serial recording data from the line memory 110 to the shift register 130 of the thermal head 13. When one-line recording data transfer is completed, the latch signal 44 is output to store the one-line recording data in the latch circuit 131. The flow advances to step S10 to adjust the number of driving steps of the ink sheet conveying motor 25 in correspondence with the value n. The ink sheet conveying motor 25 is then driven to convey the ink sheet 14 by a (1/n) line in the direction of the arrow a in FIG. 2A. In step S11, the recording paper conveying motor 24 is driven to convey the recording paper 11 by one line in the direction of the arrow b. In this case, one line corresponds to the length of one dot recorded by the thermal head 13.

The flow advances to step S12 to sequentially energize the heating elements 132 of the thermal head 13 in units of blocks. When the m blocks are energized to complete one-line image recording, the flow advances to step S13 to determine whether one-page image recording is completed. If NO in step S13, the flow returns to step S9 to transfer recording data of the next line to the thermal head 13, thereby performing image recording.

When an end of one-page image recording is determined in step S13, the flow advances to step S14 to convey the recording paper 11 toward discharge rollers 16*a* and 16*b* by a predetermined amount. Cutters 15*a* and 15*b* are driven to engage with each other to cut the recording paper into a length corresponding to one page. The one-page sheet is then discharged outside the apparatus by the discharge roller 16. In step S15, the recording paper 11 is returned by a distance corresponding to an interval between the thermal head 13 and the cutter 15 to cause the leading end of the recording paper 11 to reach the image recording position of the thermal head 13.

The CPU 113 determines in step S16 whether all received images have been recorded. If NO in step S16, the flow returns to step S9, and the above-mentioned image recording is repeated. However, if YES in step S16, the flow advances to step S17 to return the value n to the initial value, and processing is ended. The value n is returned to the initial value because image data to be received next does not always have the same recording density as the present image data, thereby preventing low-density recording of the next received image against the will of the operator.

When the ink sheet conveying motor 25 comprises a stepping motor, the value n may be changed by changing the number of steps for the ink sheet 14 with respect to one-line conveyance of the recording paper 11. In this case, the motor 25 is driven in a micro-step, so that a minimum step angle of the motor can be changed.

The ink sheet 14 during cutting of the recording paper 11 in steps S14 and S15 may be conveyed in a direction opposite to the conveying direction of the recording paper 11 as in recording at a speed $V_P/n$, or the value n may be increased. Alternatively, the ink sheet 14 may be conveyed in the same direction as the recording paper 11, or may be kept stopped.

As shown in steps S10 and S11, driving of the ink sheet conveying motor 25 is preferably started before driving of the recording paper conveying motor 24 due to the following reason. Even if the ink sheet conveying motor 25 is driven, a delay time is required to start actual conveyance of the ink sheet due to the characteristics of the motor and the driving/transmitting system. The same effect as described above can be obtained even if driving of the recording paper conveying motor 24 is started before that of the ink sheet conveying motor 25. However, when a long time is provided from the start of conveyance of the recording paper 11 to driving (recording operation in step S12) of the thermal head 13, a gap may be undesirably formed between the recorded dots.

Another conveying mechanism applied to this embodiment will be described below. Unlike the above embodiment in which the take-up roller 18 is directly driven, an ink sheet 14 is conveyed by a capstan roller 71 and a pinch roller 72 in a direction of an arrow a, so that the ink sheet 14 can always be conveyed by a predetermined amount regardless of a take-up diameter of the ink sheet take-up roller 18. The same reference numerals as in FIG. 6 denote the same parts in FIG. 15, and a detailed description thereof will be omitted.

According to this embodiment as described above, the conveying amount of the ink sheet 14 with respect to one-line conveyance of the recording paper 11 can be changed in accordance with the number of input receiving sheets and the remaining amount of the ink sheet. Therefore, the image information to be recorded can be recorded with the presently remaining amount of the ink sheet.

In addition, when a switch for designating whether the conveying amount of the ink sheet 14 with respect to the recording paper 11 is adjusted is arranged, an operator is allowed to select whether recording of remaining sheets with the present remain of the ink sheet has priority over the image quality.

Furthermore, the operator can designate the conveying amount of the ink sheet 14 with respect to one line of the recording paper 11.

This embodiment exemplifies the recording unit of the facsimile apparatus, but is not limited thereto. The present invention is also applicable to a normal thermal transfer printer. In this case, the number of recording sheets is input from host equipment which outputs recording data. The conveying amount of the ink sheet may be adjusted on the printer side in accordance with the input number of sheets and the remaining amount of the ink sheet.

According to the above embodiment as described above, the length of use of the ink sheet with respect to the recording medium having a predetermined length is decreased in correspondence with the remain of the ink sheet. Image recording of recording data having a desired length can be completed with the presently remaining amount of the ink sheet.

According to this embodiment, the operator can select whether the conveying length of the ink sheet with respect to the recording medium having a predetermined length is changed.

Still another embodiment of the present invention will be described with reference to FIGS. 16 to 20. A side sectional view showing the mechanism of a facsimile apparatus is represented by FIG. 2A, and a flow chart showing recording processing is represented by FIG. 8.

This embodiment exemplifies an operation for receiving the number of multi-print cycles of an ink sheet from a transmitting side to a receiving side and determining a conveying amount of the ink sheet with respect to a predetermined image recording length of a recording medium. Every time image recording of a predetermined length is performed on a recording medium, a multi-print operation is performed so as to convey the ink sheet in correspondence with the determined conveying amount.

A schematic arrangement will be described with reference to FIG. 16. The same reference numerals as in FIG. 6 denote the same parts in FIG. 16, and a detailed description thereof will be omitted.

Figure 16:
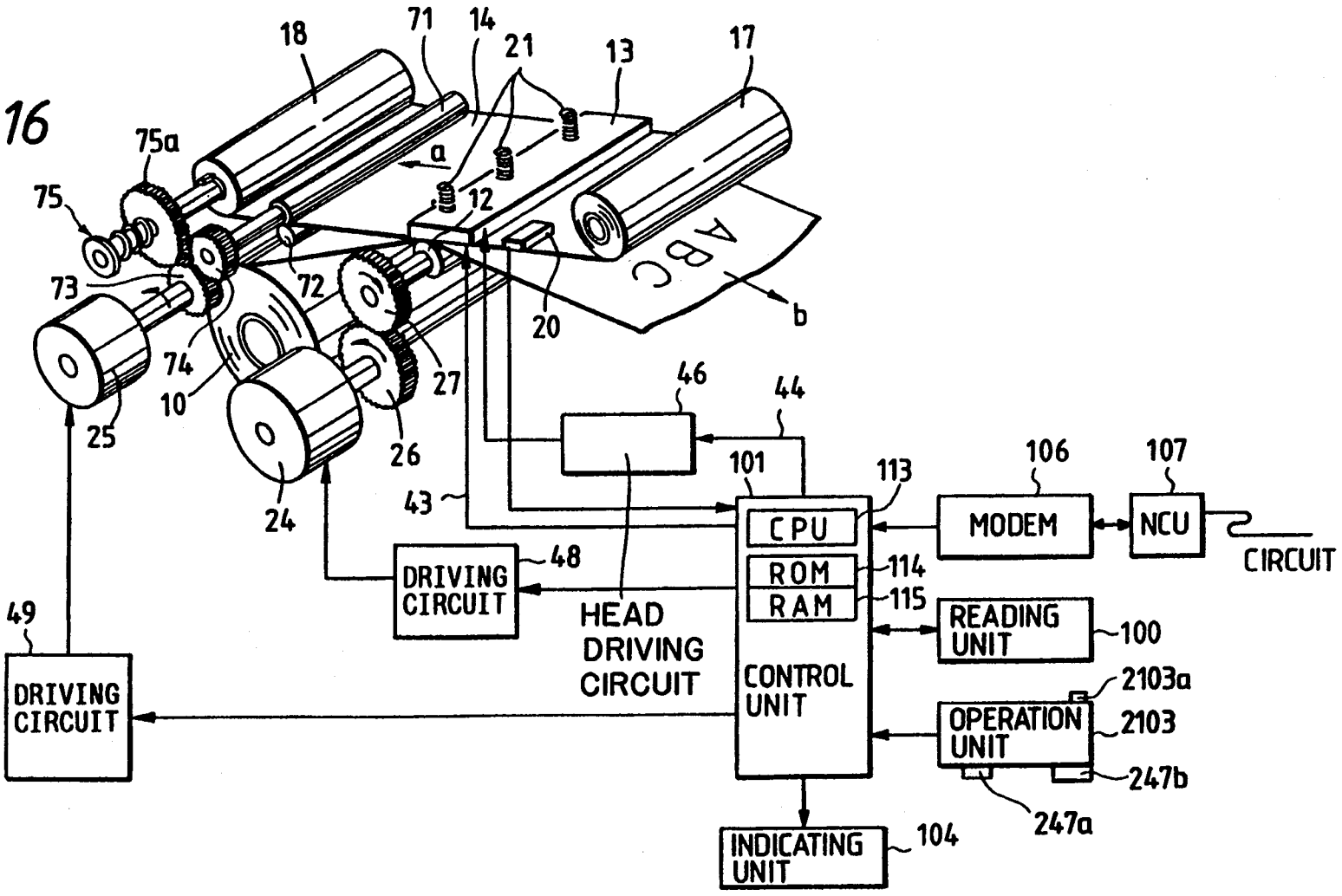
FIG. 16 is a block diagram showing a schematic arrangement of a facsimile apparatus and an arrangement of a conveying/driving system of recording paper and an ink sheet according to still another embodiment of the present invention.

Referring to FIG. 16, an operation unit 2103 includes various function keys (e.g., a transmission start key) and input keys (e.g., telephone number keys). The operation unit 2103 designates the number of multi-print cycles upon its reception. The operation unit 2103 also includes a key 247*a* such as a DIP switch for designating the number of multi-print cycles in the apparatus. The operation unit 2103 further includes a transmitting n value designation key 247*b*. The key 247*b* is used to designate a value n for the receiving facsimile apparatus. In this embodiment, the number of multi-print cycles transmitted from the transmitting side has priority over the number of multi-print cycles set with the key 247*b*. A switch 2103*a* in the operation unit 2103 is used to designate to a control unit 101 that a multi-print ink sheet is loaded.

FIG. 16 shows a conveying system for recording paper 11 and an ink sheet 14 in a recording unit in detail. The conveying unit includes reduction gears 73 and 74 and a slip clutch unit 75. When an ink sheet conveying motor 25 and a recording paper conveying motor 24 are driven, a value of a reduction gear ratio $i_I$ of the reduction gears 73 and 74 and a value of a reduction gear ratio $i_P$ of gears 26 and 27 is appropriately set to determine a number n of multi-print cycles. The numbers of driving steps of the recording paper conveying motor 24 and the ink sheet conveying motor 25 are changed to cope with various numbers n designated by the transmitting side. When a gear 73 is engaged with a gear 75*a* of the slip clutch 75, a take-up roller 18 can take up the ink sheet 14 conveyed by a capstan roller 71 and a pinch roller 72.

When a ratio of gear 73 to gear 75*a* is set such that a length of the ink sheet 14 taken up by the take-up roller 18 is set to be longer than a length of the ink sheet conveyed by the capstan roller 71, the ink sheet 14 conveyed by the capstan roller 71 can be perfectly taken up by the take-up roller 18. A difference between the take-up amount of the ink sheet 14 by the take-up roller 18 and the ink sheet 14 conveyed by the capstan roller 71 is absorbed by the slip clutch unit 75. Therefore, a variation (i.e., a change in value n) in conveying speed of the ink sheet which is caused by a change in take-up diameter of the take-up roller 18 can be prevented.

Transmitting/receiving processing will be described with reference to FIGS. 17 to 19.

Figure 17:
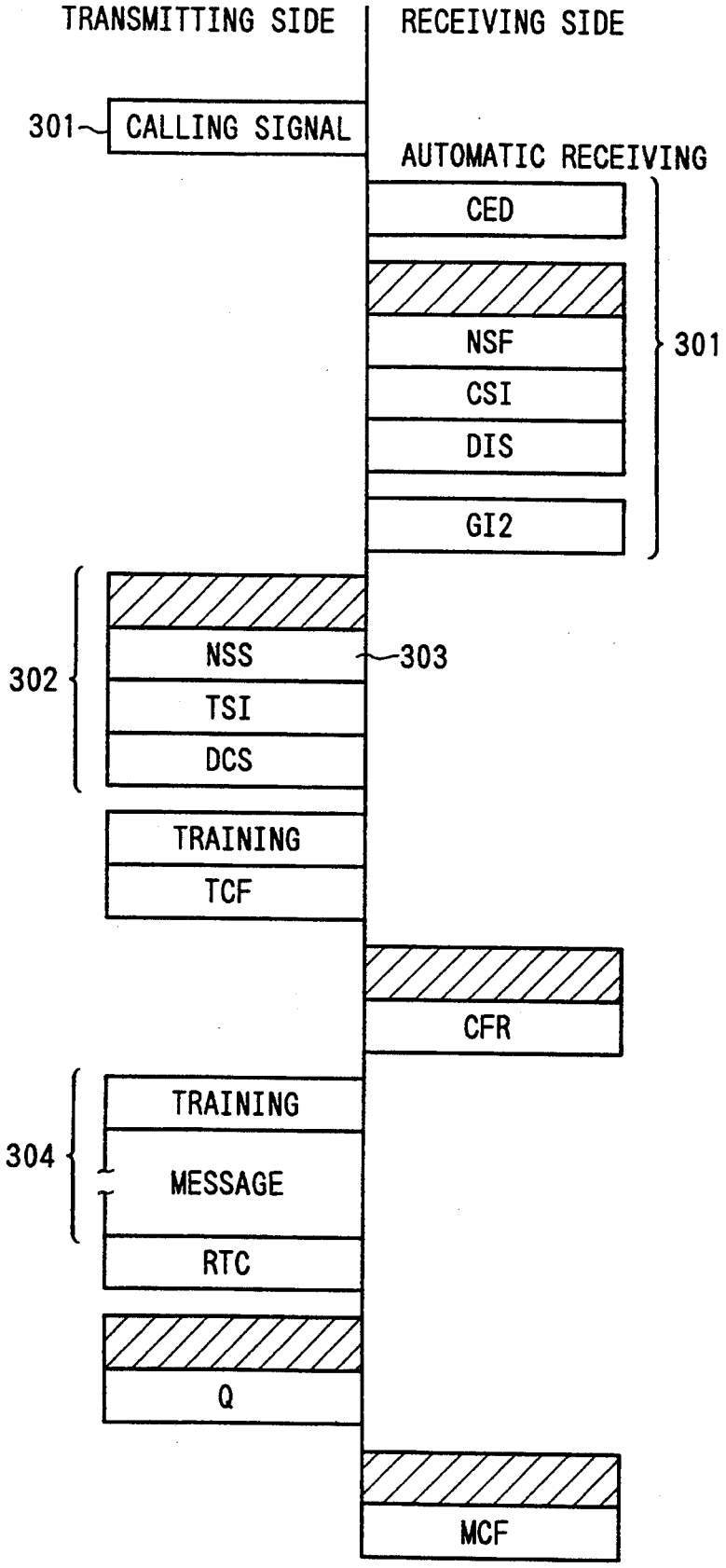
FIG. 17 is a view showing a transmitting/receiving control sequence of the facsimile apparatus shown in FIG. 16.

FIG. 17 shows a control sequence of facsimile communication applied to this embodiment.

In step 301, dialing is performed at the facsimile apparatus on the transmitting side, and the call is automatically received by the facsimile apparatus on the receiving side, so that the line is switched from the telephone mode to the facsimile mode. In step 301, the receiving side sends back a called identification (CED) signal, a digital identification signal (DIS), and a group identification (GI2) signal. The transmitting side transmits a transmitting station identification (TSI) signal, a nonstandard signal (NSS) 303 such as the value n designated with the transmitting n value designation key 247*b*, and a digital command signal (DCS). The transmitting side then outputs a training signal. In step 304, a message signal as a transmitting image signal is sent out.

Figure 18:
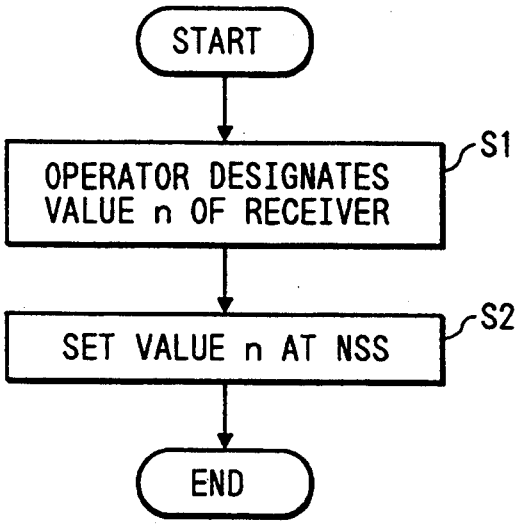
FIG. 18 is a flow chart showing processing for designating the value n at the transmitting side.
Figure 19:
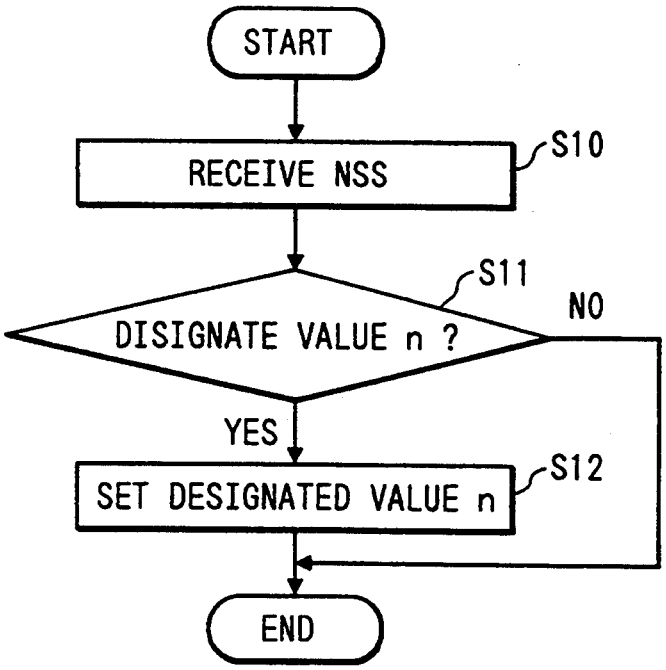
FIG. 19 is a flow chart showing processing for setting the value n at the receiving side.

FIG. 18 is a flow chart showing n value designation processing on the transmitting side, and FIG. 19 is a flow chart showing receiving processing of the facsimile apparatus on the receiving side. The programs for executing these control operations are stored in a ROM 114.

The CPU 113 determines in step S1 whether a value n is set with the transmitting n value designation key 247*b* of the operation unit 2103 in the facsimile apparatus of the receiving side. If YES in step S1, the designated value n is set in the nonstandard signal NSS defined in the CCITT T30 in step S2.

FIG. 19 is a flow chart showing processing for setting a value n in the facsimile apparatus of the receiving side.

In step S10, upon reception of the signal NSS, the flow advances to step S11 to check if the value n is set. If YES in step S11, the flow advances to step S12 to store the value n in the RAM 115. At the same time, for example, a conveying length of the ink sheet 14 with respect to one line of the recording paper 11 is determined to perform recording of the received image (to be described later).

A recording operation of this embodiment will be described below.

Figure 20:
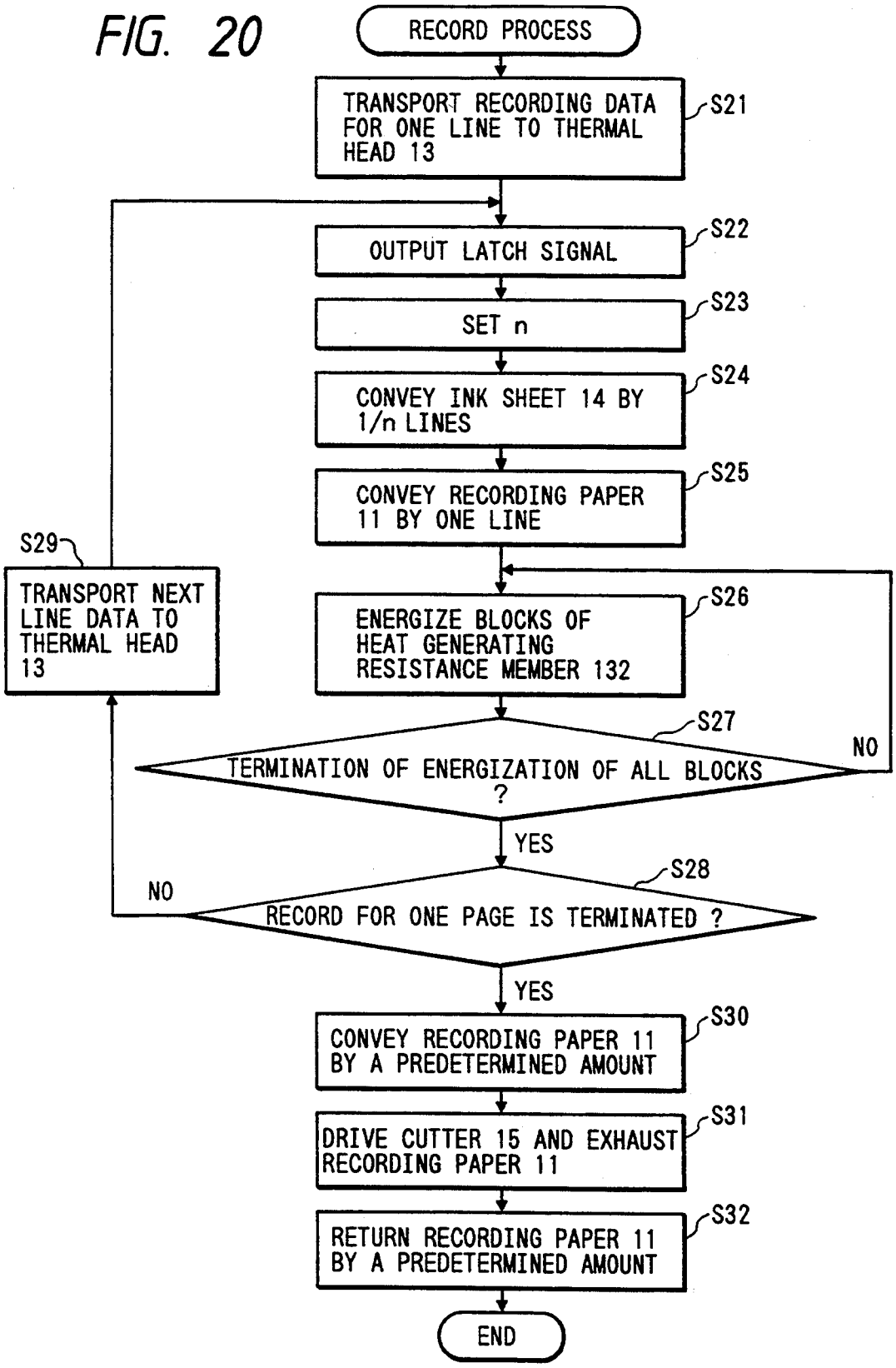
FIG. 20 is a flow chart showing recording processing in the facsimile apparatus shown in FIG. 16.

FIG. 20 is a flow chart of one-page recording processing in the facsimile apparatus of this embodiment. The control program for executing the above processing is stored in the ROM 114 in the control unit 101.

This processing is started when the image signal is received, the image data is stored in the memory of the control unit 101, and a recording operation is ready to start. In step S21, one-line serial recording data is output to the thermal head 13. When one-line recording data transfer is completed, a latch signal is output in step S22 to store the one-line recording data in a latch circuit of the thermal head 13. In step S23, the number n of multi-print cycles is set in accordance with the value n designated from the transmitting side in the flow chart of FIG. 17 and set on the receiving side in the flow chart of FIG. 18. In this case, if the value n is not designated from the transmitting side, the value n designated with the switch 247*a* of the operation unit 2103 is set. The conveying length (1/n line) of the ink sheet 14 during image recording is determined.

The flow advances to step S24 to drive the ink sheet conveying motor 25 to convey the ink sheet 14 by a (1/n) line based on the value n obtained in step S23 in the direction indicated by the arrow a in FIG. 16. In step S25, the recording paper conveying motor 24 is driven to convey the recording paper 11 by one line in the direction indicated by the arrow b. The length of one line is set to be, e.g., about 1/15.4 mm in the facsimile apparatus. The conveying amounts of the recording paper 11 and the ink sheet 14 are set by changing the numbers of excitation pulses of the recording paper conveying motor 24 and the ink sheet conveying motor 25.

Assume that each of the recording paper conveying motor 24 and the ink sheet conveying motor 25 is driven in 1–2 phase energization, that the recording paper 11 is conveyed by one line every energization cycle, and that the ink sheet 14 is conveyed by the same length as that of the recording paper 11 by 20 energization cycles. If the number of multi-print cycles is 5 and the recording sheet is conveyed by one line, the ink sheet 14 is conveyed by 1/5 line by four energization cycles, and its conveying distance is $1/(15.4\times5)$ mm.

The flow then advances to step S26 to energize each block of heating elements 132 of the thermal head 13. The CPU 113 determines in step S27 whether all the blocks are energized. When all the blocks of the heating elements 132 are energized to complete one-line image recording, the flow advances to step S28 to check whether one-page image recording is completed. If NO in step S28, the flow advances to step S29, and recording data of the next line is transported or transferred to the thermal head 13, and the flow returns to step S22.

When one-page image recording is completed in step S28, the flow advances to step S30 to convey the recording paper 11 toward discharge rollers 16*a* and 16*b* by a predetermined amount. In step S30, cutters 15*a* and 15*b* are driven and engaged with each other to cut the recording paper 11 in page lengths. In step S32, the recording paper 11 is returned by a distance corresponding to a distance between the thermal head 13 and the cutter 15, thereby completing one-page image recording processing.

In a series of cutting operations of the recording paper 11 by the cutter 15 in steps S30 to S32, the ink sheet may be conveyed in a direction opposite to that of the recording paper 11 at a speed of $V_P/n$ as in recording. The value n may be larger than that during recording. The same operation as the recording paper 11 may be performed by the platen roller 12, and the ink sheet may be kept stationary.

In this embodiment, the nonstandard signal NSS is used as a signal for designating the value n from the facsimile apparatus of the transmitting side to the facsimile apparatus of the receiving side. However, another control sequence signal may be used.

In addition, the number of multi-print cycles represented by the mark formed on the ink sheet or ink sheet cartridge may be read and input, and the number of multi-print cycles of the facsimile apparatus may be set.

According to this embodiment as described above, the operator can set the value n of the receiving facsimile on the receiving side when the transmitting original has a low density. The reproduced image can have a higher density. When the remaining amount of the ink sheets of the receiving side will be able to be recognized in the near future, the value n can be designated to the receiving side in accordance with the remaining amount of the ink sheet and the number of input receiving sheets. Therefore, transmitted original image can be perfectly reproduced on the receiving side.

The above embodiment exemplifies a facsimile apparatus using a thermal line head, but the present invention is not limited thereto. For example, an ink ribbon of the same material as that of the ink sheet as described in this embodiment and a serial head are used to perform multi-printing. More specifically, the take-up amount of the ink ribbon mounted on a carriage is changed in a direction for moving the carriage (i.e., a recording direction) in accordance with the switch 247 and the type of ink sheet, thereby performing multi-printing by a predetermined number of times. In this case, for example, when the carriage is moved to the right, the ink ribbon is conveyed from the left to the right with respect to the thermal head.

According to the above embodiment as described above, the number of multi-print cycles can be arbitrarily designated from the facsimile apparatus of the transmitting side, and the conveying distance of the ink sheet with respect to the recording medium can be arbitrarily changed on the receiving side in accordance with the designated number of multi-print cycles, thereby performing recording with the arbitrary number of multi-print cycles.

A heating scheme is not limited to the thermal head scheme using the thermal head, but may be replaced with an electrothermosenstive or laser transfer scheme.

In the above embodiment, a full-line type thermal head is exemplified, but may be replaced with a so-called serial type thermal head.

The recording medium is not limited to recording paper. If an ink transfer operation is allowed, the recording medium may be, e.g., a piece of fabric or a plastic sheet. In addition, the ink sheet is not limited to the roll as described in the above embodiments. For example, ink sheets may be stored in a box detachable from a recording unit. A so-called ink sheet cassette which is detachably loaded in the recording unit may be used.

In each embodiment, the conveying direction of the recording paper 11 is opposite to that of the ink sheet 14 during recording. However, the conveying operation is not limited to this. They may be conveyed in the same direction.

According to the present invention as has been described above, the consumption of the ink sheet can be reduced, and clear, high-quality recording can be performed.

What is claimed is:

1. A thermal transfer recording apparatus for transferring an ink of an ink sheet to a recording sheet to record an image on the recording sheet, comprising:

a thermal head having a plurality of heat generating elements disposed in correspondence with a recordable width of the recording sheet;

a recording sheet mounting section for mounting the recording sheet:

a recording sheet conveying mechanism for conveying the recording sheet in a conveyance direction;

an ink sheet mounting section for mounting a multi-print ink sheet, which contains said ink in an amount sufficient for recording a number of times which is a number of multi-print, for recording along the recordable width of the recording sheet;

an ink sheet conveying mechanism for conveying the ink sheet, said ink sheet conveying mechanism conveying the ink sheet in a direction opposite to the conveyance direction of the recording sheet at a recording area when recording; and a control mechanism for controlling setting of the number of multi-print of the ink sheet in response to a kind of said image to be recorded and conveyance by said ink sheet conveying mechanism in response to the set number of multi-print when recording.

2. An apparatus according to claim 1, wherein the ink sheet conveying mechanism conveys the ink sheet at a conveying speed, the recording sheet conveying mechanism conveys the recording sheet at a moving speed, and a ratio of the conveying speed of the ink sheet to the moving speed of the recording sheet is set to be $1/n$ $(n>1)$.

3. An apparatus according to claim 1, further comprising determining means for determining a relative speed of the ink sheet with respect to the recording sheet, said ink sheet conveying mechanism comprising a motor, and wherein the relative speed determined by said determining means is changed by changing a speed of said ink sheet conveying motor.

4. An apparatus according to claim 1, wherein the ink of the ink sheet is a thermally meltable ink.

5. An apparatus according to claim 1, wherein the ink of the ink sheet is a thermally sublimable ink.

6. A thermal transfer recording apparatus according to claim 1 wherein the image is recorded according to an image information, and wherein the image information is of a type used to effect high-resolution recording.

7. A thermal transfer recording apparatus according to claim 1 wherein the image is recorded according to an image information, and wherein the image information is of a type used to effect standard-resolution recording.

8. A thermal transfer recording apparatus according to claim 1 wherein the image is recorded according to an image information, and wherein the image information is of a type used to record an image of a photographic original.

9. A thermal transfer recording apparatus according to claim 1 wherein the image is recorded according to an image information, and wherein the image information is of a type used to record an image of a character original.

10. A thermal transfer recording apparatus according to claim 1, further comprising determining means for determining a relative speed of the ink sheet with respect to the recording sheet, wherein said determining means determines the relative speed based upon an external information.

11. A thermal transfer recording apparatus according to claim 1, further comprising determining means for determining a relative speed of the ink sheet with respect to the recording sheet, wherein said determining means determines the relative speed based upon an information from an operation unit provided on said recording apparatus.

12. A thermal transfer recording apparatus according to claim 1, wherein said recording apparatus is a facsimile apparatus comprising a receiving mechanism for receiving an image information through an external communication line.

13. A thermal transfer recording method for transferring an ink of a multi-print ink sheet, which contains said ink in an amount sufficient for recording a number of times which is a number of multi-print, for recording by using a thermal head having a plurality of heat generating elements disposed in correspondence with a recordable width of a recording sheet to record an image on the recording sheet, said method comprising the steps of:

setting the number of multi-print of the ink sheet in response to a kind of a recording image;

determining a driving condition of an ink sheet conveying mechanism in response to the set number of multi-print in said setting step; and conveying the recording sheet in a conveyance direction and driving said ink sheet conveying mechanism in response to the driving condition determined at said determining step, conveying said ink sheet in a direction opposite to said conveyance direction of the recording sheet at a recording area when recording.

14. A method according to claim 13, wherein the ink sheet is conveyed in said conveying step at a conveying speed, the recording sheet is conveying in said conveying step at a moving speed, and a ratio of the conveying speed of the ink sheet to the moving speed of the recording sheet is set to be $1/n$ ($n>1$).

15. A method according to claim 3, wherein the ink of the ink sheet is a thermally meltable ink.

16. A method according to claim 3, wherein the ink of the ink sheet is a thermally sublimable ink.

17. A method according to claim 13 wherein the image is recorded according to an image information, and wherein the image information is of a type used to effect high-resolution recording.

18. A method according to claim 13 wherein the image is recorded according to an image information, and wherein the image information is of a type used to effect standard-resolution recording.

19. A method according to claim 13 wherein the image is recorded according to an image information, and wherein the image information is of a type used to record an image of a photographic original.

20. A method according to claim 13 wherein the image is recorded according to an image information, and wherein the image information is of a type used to record an image of a character original.

21. A method according to claim 13, further comprising a step of changing a relative speed of the ink sheet with respect to the recording sheet, wherein said relative speed is changed in accordance with an external information.

22. A method according to claim 13, further comprising a step of changing a relative speed of the ink sheet with respect to the recording sheet, wherein said relative speed is changed in accordance with an information from an operation unit provided on a recording apparatus.

23. A thermal transfer recording method according to claim 13, wherein said method is used in a facsimile apparatus comprising a receiving mechanism for receiving an image information through an external communication line.

* * * * *